US012668904B2

(12) United States Patent
Nakano et al.

(10) Patent No.: US 12,668,904 B2
(45) Date of Patent: Jun. 30, 2026

(54) SEWING MACHINE AND SEWING MACHINE CONTROL METHOD

(71) Applicant: BROTHER KOGYO KABUSHIKI KAISHA, Nagoya (JP)

(72) Inventors: Takashi Nakano, Ama (JP); Mika Matsushima, Ichinomiya (JP)

(73) Assignee: BROTHER KOGYO KABUSHIKI KAISHA, Nagoya (JP)

( * ) Notice: Subject to any disclaimer, the term of this patent is extended or adjusted under 35 U.S.C. 154(b) by 0 days.

(21) Appl. No.: 19/090,750

(22) Filed: Mar. 26, 2025

(65) Prior Publication Data

US 2025/0305196 A1 Oct. 2, 2025

(30) Foreign Application Priority Data

Mar. 28, 2024 (JP) ..... 2024-054608

(51) Int. Cl.
*D05B 19/12* (2006.01)
*D05B 19/10* (2006.01)
*D05B 79/00* (2006.01)

(52) U.S. Cl.
CPC ..... *D05B 19/12* (2013.01); *D05B 19/10* (2013.01); *D05B 79/00* (2013.01)

(58) Field of Classification Search
CPC ..... D05B 19/10; D05B 19/12; D05B 79/00; D05C 5/00; D05C 5/02
See application file for complete search history.

(56) References Cited

U.S. PATENT DOCUMENTS 5,140,677 A * 8/1992 Fleming ..... G06F 3/0481 715/810
5,954,004 A * 9/1999 Futamura ..... D05B 19/10 112/102.5
2014/0182499 A1* 7/2014 Matsushima ..... D05B 19/12 700/137
2020/0299884 A1* 9/2020 Imaizumi ..... D05B 35/12

FOREIGN PATENT DOCUMENTS

JP 2014-124464 A 7/2014

* cited by examiner

*Primary Examiner* — Nathan E Durham
(74) *Attorney, Agent, or Firm* — Oliff PLC

(57) ABSTRACT

A sewing machine includes a bed, a projector, and a controller. The controller is configured to control the projector to project a projection image onto a projection region on the bed. The projection image includes a pattern image representing a sewing pattern and a projection setting object for instructing setting of the sewing pattern. The controller is configured to, in response to selection of the projection setting object during a period in which the projection image is being projected, perform the setting of the sewing pattern. The controller is configured to change at least a size or an arrangement of the projection setting object in the projection image.

18 Claims, 13 Drawing Sheets

FIG. 13

87

| FP | DISPLAY TYPE OBJECT | DISPLAY IMAGE | | PROJECTION IMAGE | | | |
|---|---|---|---|---|---|---|---|
| | | PROJECTION IS NOT BEING PERFORMED | PROJECTION IS BEING PERFORMED | PROJECTION SETTING OBJECT | PROJECTION ORDER | MULTIPLE PATTERN RESTRICTED ITEM | GROUPED PATTERN RESTRICTED ITEM |
| F1 | | YES | YES | PROJECTION SETTING OBJECT M3, M6 | 2 | ALL RESTRICTION | ALL RESTRICTION |
| F2 | | YES | YES | PROJECTION SETTING OBJECT M1, M7 | 1 | NO RESTRICTION | NO RESTRICTION |
| F3 | | YES | YES | NO | NO | NO | NO |
| F4 | | YES | YES | PROJECTION SETTING OBJECT M4, M5 | 3 | ALL RESTRICTION | PARTIAL RESTRICTION |
| F5 | | YES | YES | NO | NO | NO | NO |
| F6 | | YES | YES | NO | NO | NO | NO |
| F7 | | YES | YES | NO | NO | NO | NO |
| F8 | | YES | YES | NO | NO | NO | NO |
| F9 | | YES | NO | NO | NO | NO | NO |
| F10 | | YES | NO | NO | NO | NO | NO |
| F11 | T | YES | NO | NO | NO | NO | NO |
| F12 | | YES | YES | NO | NO | NO | NO |
| F13 | | YES | NO | NO | NO | NO | NO |
| F14 | | YES | NO | NO | NO | NO | NO |
| F15 | | YES | YES | NO | NO | NO | NO |
| F16 | | YES | NO | NO | NO | NO | NO |

SEWING MACHINE AND SEWING MACHINE CONTROL METHOD

REFERENCE TO RELATED APPLICATIONS

This application claims priority from Japanese Patent Application No. 2024-054608 filed on Mar. 28, 2024. The entire content of the priority application is incorporated herein by reference.

BACKGROUND ART

A sewing machine including a projector for projecting an image onto a bed is known.

SUMMARY

When a sewing machine detects ultrasonic wave, the sewing machine identifies a position on a sewing workpiece of a transmission source of the ultrasonic wave as a designated position. The sewing machine projects a menu image at a position outside a sewing region. The sewing machine inputs various instructions necessary for determining an edit pattern based on the designated position and the projection position of the menu image.

In the above-mentioned sewing machine, depending on shapes of the sewing region, an embroidery frame, and a projection region, a space for projecting a setting object may not be sufficiently secured. Thus, in the above-mentioned sewing machine, the visibility of the projection setting object may be impaired.

In view of the foregoing, an example of an object of this disclosure is to provide a sewing machine that contributes to avoiding a situation in which the visibility of a setting object projected onto a bed is impaired.

According to one aspect, this specification discloses a sewing machine. The sewing machine includes a bed, a projector, and a controller. The controller is configured to control the projector to project a projection image onto a projection region on the bed. The projection image includes a pattern image representing a sewing pattern and a projection setting object for instructing setting of the sewing pattern. The projection setting object contributes to performing setting of the sewing pattern in the projection image. The controller is configured to, in response to selection of the projection setting object during a period in which the projection image is being projected, perform the setting of the sewing pattern. The controller is configured to change at least a size or an arrangement of the projection setting object in the projection image (change process). The change process performed by the controller of the sewing machine contributes to avoiding a situation in which the visibility of the projection setting object projected on the bed is impaired, compared with a conventional sewing machine in which the change process is not performed.

According to another aspect, this specification discloses a sewing machine. The sewing machine includes a bed, a projector, and a controller. The controller is configured to control the projector to project a projection image toward the bed. The projection image includes a pattern image and a projection setting object. The pattern image represents a shape of stitches of a sewing pattern. The projection setting object is an object for instructing setting of the sewing pattern. A position of the projection setting object is changeable, which contributes to securing the visibility of the projection setting object.

According to still another aspect, this specification discloses a sewing machine control method. The control method includes projecting, by a projector of a sewing machine, a projection image toward a bed of the sewing machine. The projection image includes a pattern image, a projection setting object, and a position designation object. The pattern image represents a shape of stitches of a sewing pattern. The projection setting object is an object for instructing setting of the sewing pattern. The position designation object is an object for designating a position of the projection setting object. The control method includes selecting the position designation object when light emission of a pointing body is detected, by an image sensor, at a position where the position designation object is projected. The control method includes arranging, in response to selection of the position designation object, the projection setting object at a position designated by the position designation object. The arranging the projection setting object at the position designated by the position designation object contributes to securing the visibility of the projection setting object.

BRIEF DESCRIPTION OF DRAWINGS

FIG.13 is an explanatory diagram of a table 87.

DESCRIPTION

Figure 1:
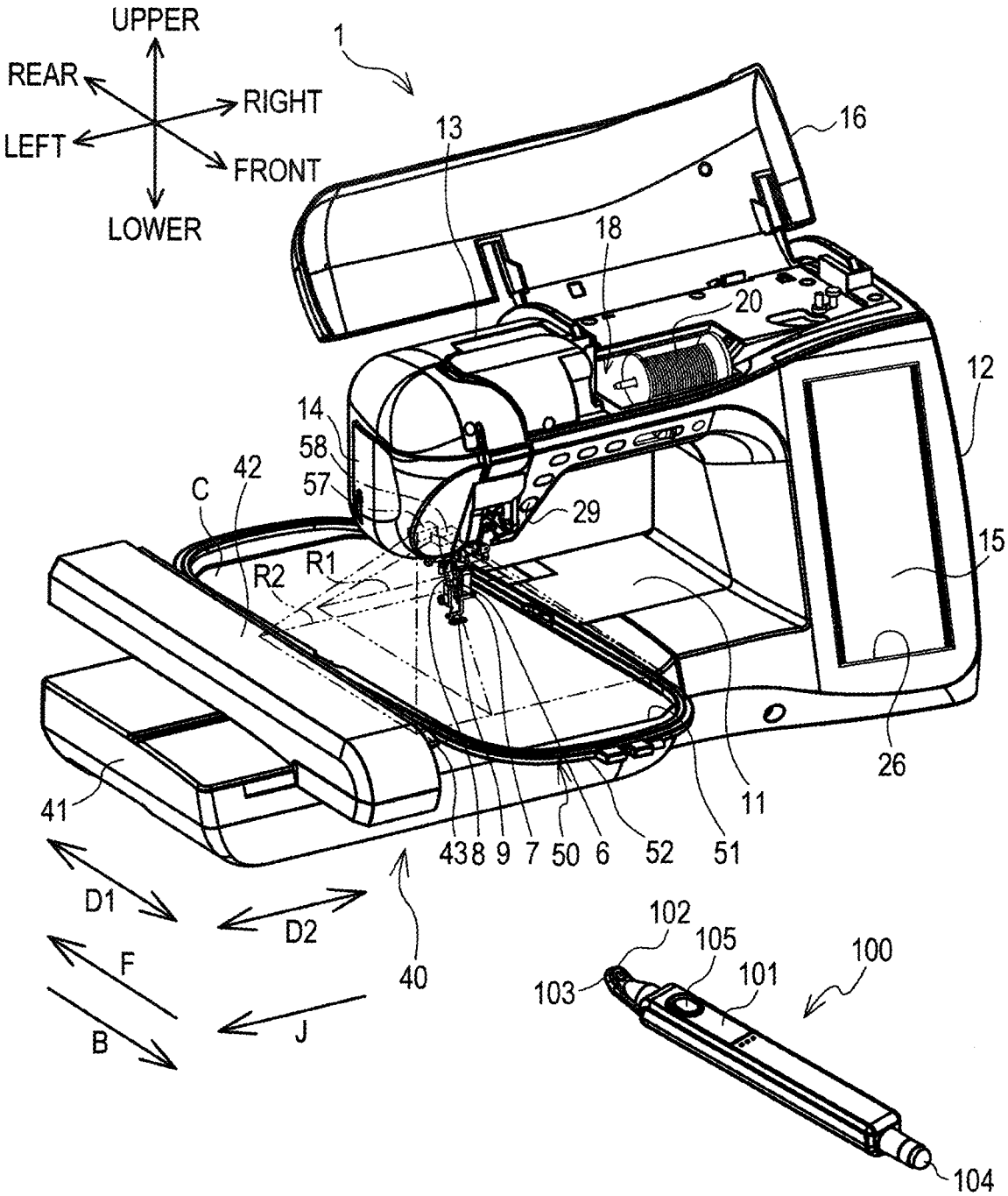
FIG. 1 is a perspective view of a sewing machine 1.

A sewing machine 1 of an embodiment of the present disclosure will be described with reference to the drawings. The structural configuration of the sewing machine 1 to which a movement device 40 is attached will be described with reference to FIG. 1. The upper-lower direction, the lower right side, the upper left side, the lower left side, and the upper right side in FIG. 1 are respectively the upper-lower direction, the front, the rear, the left, and the right of the sewing machine 1 to which the movement device 40 is attached. A longitudinal direction D2 of a bed 11 and an arm 13 is the left-right direction of the sewing machine 1. A short direction D1 of the bed 11 and the arm 13 is the front-rear direction of the sewing machine 1. The side on which a pillar 12 is disposed is the right side. The direction in which the pillar 12 extends is the upper-lower direction of the sewing machine 1. In the following description, a sewing pattern is also simply referred to as a pattern.

As shown in FIG. 1, the sewing machine 1 includes the bed 11, the pillar 12, the arm 13, a head 14, and the movement device 40. The bed 11 is a base portion of the sewing machine 1 that extends in the left-right direction. The pillar 12 is provided to stand upward from the right end of the bed 11. The arm 13 extends in an extending direction J from the upper end of the pillar 12 so as to face the bed 11. The extending direction J of the present example is leftward. The head 14 is a portion connected to the left end of the arm 13.

Figure 2:
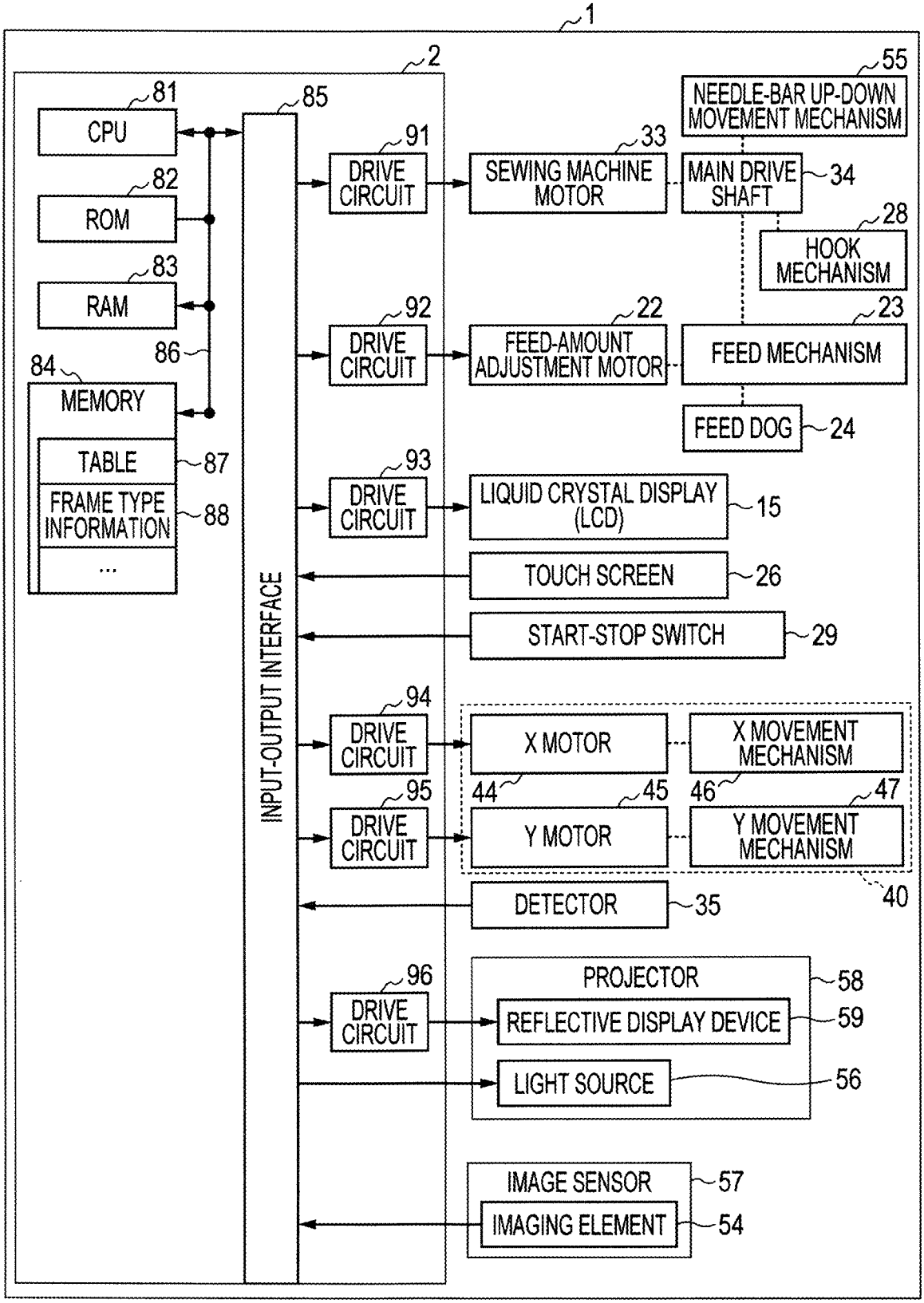
FIG. 2 is a block diagram showing an electrical configuration of the sewing machine 1.

The bed 11 includes a needle plate (not shown) on an upper surface of the bed 11. The needle plate is formed with a needle hole (not shown) through which a sewing needle 7 described later is inserted. As shown in FIG. 2, the sewing machine 1 includes a feed dog 24, a feed mechanism 23, a hook mechanism 28, and so on, inside the bed 11. The feed dog 24 is driven by the feed mechanism 23 during normal sewing that is not embroidery sewing, and moves a sewing workpiece in a forward feed direction F or a reverse feed direction B by a particular movement amount. In this example, the forward feed direction F is rearward, and the reverse feed direction B is forward. The hook mechanism 28 entwines an upper thread (not shown) with a lower thread below the needle plate.

The pillar 12 includes a sewing machine motor 33 shown in FIG. 2 therein. An LCD 15 is provided on a front surface of the pillar 12. The LCD 15 displays images including various items such as commands, illustrations, setting values, and messages. A touch screen 26 configured to detect a pressed position is provided on the front surface side of the LCD 15. When the user performs a pressing operation on the touch screen 26 using a pointing body such as a finger or a pen 100 (a pointing device) described later, the touch screen 26 detects the pressed position. A controller 2 of the sewing machine 1 shown in FIG. 2 recognizes an item selected in an image based on the detected pressed position. Hereinafter, the pressing operation of the touch screen 26 by the user is referred to as a panel operation. The user selects a sewing pattern to be sewn, a command to be performed, and so on, by a panel operation.

A cover 16 configured to be opened and closed is provided on an upper portion of the arm 13. FIG. 1 shows the cover 16 in an open state. A thread storage portion 18 is provided below the cover 16 when the cover 16 is closed, that is, inside the arm 13. The thread storage portion 18 stores a thread spool 20 around which an upper thread is wound. A main drive shaft 34 shown in FIG. 2 is provided inside the arm 13. The main drive shaft 34 extends in the left-right direction and is rotationally driven by the sewing machine motor 33. Various switches including a start-stop switch 29 are provided on a left lower portion of the front surface of the arm 13. The start-stop switch 29 is used to start or stop an operation of the sewing machine 1, that is, to input an instruction to start or stop sewing by the user.

A needle bar 6, a presser bar 8, a projector 58, an image sensor 57, and so on, are provided at the head 14. The needle bar 6 extends in the upper-lower direction. The needle bar 6 is located above the needle hole. The sewing needle 7 is detachably attached to the lower end of the needle bar 6. The needle bar 6 is connected to a needle bar up-down movement mechanism 55 shown in FIG. 2, and is driven in the upper-lower direction by the rotation of the main drive shaft 34. A presser foot 9 is detachably attached to the lower end of the presser bar 8. The presser foot 9 is movable together with the presser bar 8 between a lowered position at which the presser foot 9 presses the sewing workpiece C and a raised position at which the presser foot 9 is retracted upward from the lowered position, that is, the presser foot 9 is separated from the sewing workpiece C. The presser foot 9 intermittently presses the sewing workpiece C downward in conjunction with the up-down movement of the needle bar 6.

The projector 58 is configured to project a projection image toward the bed 11. The projector 58 includes a cylindrical housing (not shown), and a reflective display device 59 and a light source 56 shown in FIG. 2 which are accommodated in the housing. The projector 58 further includes an imaging lens (not shown). The housing is fixed to a machine frame (not shown) in the head 14. The light source 56 of the present example is an LED. The reflective display device 59 modulates light from the light source 56 and forms image light of a projection image based on image data representing the projection image. The imaging lens forms an image of the image light formed by the reflective display device 59 on the sewing workpiece C held by an embroidery frame 50. The embroidery frame 50 is attached to a holder 43. The region onto which the projector 58 projects the projection image is referred to as a projection region R1. The projection region R1 includes a position below the needle bar 6, that is, a position corresponding to the needle hole. The projection region R1 is a region uniquely determined according to an attachment position and an attachment posture of the projector 58, a distance from the imaging lens to the upper surface of the sewing workpiece C, and so on. Since the projector 58 projects the projection image from obliquely above with respect to the sewing workpiece C and the bed 11, the projection image is subjected to a process of correcting distortion of the image. The size of the projection region R1 of the projector 58 is stored in a memory (storage) 84 in advance. The size of the projection region R1 is, for example, the number of dots of the long side and the short side of a rectangular region. The projection region R1 of the projector 58 has a rectangular shape in which two sides extending in the short direction D1 are long sides and two sides extending in the longitudinal direction D2 are short sides. That is, the longitudinal direction of the projection region R1 is the front-rear direction, and the short direction of the projection region R1 is the left-right direction. The projection image may be a color image or a monochrome image. The color of the projection image may be adjustable in accordance with the color, the pattern, and so on, of the sewing workpiece C.

The image sensor 57 is configured to capture an image of the bed 11. The image sensor 57 includes a lens (not shown) and an imaging element 54 shown in FIG. 2. The image sensor 57 is fixed to the head 14 in a posture in which the lens is directed downward. An example of a capturing target of the image sensor 57 is a projection image projected on the sewing workpiece C. Reflected light reflected by the capturing target is incident on the lens. The lens guides the incident reflected light to the imaging element 54. The imaging element 54 is a CMOS image sensor, which detects the reflected light guided by the lens, and outputs a signal corresponding to the detected reflected light. The imaging element 54 is not limited to the CMOS image sensor, and may be an image sensor operating in another method such as a CCD image sensor.

A region captured by the image sensor 57 is referred to as a capturing region R2. The capturing region R2 includes at least a part of the projection region R1 of the projector 58. The capturing region R2 has a rectangular shape in which sides extending in the short direction DI are short sides and sides extending in the longitudinal direction D2 are long sides. The end of the capturing region R2 in the extending direction J is located further in the extending direction J than the end of the bed 11 in the extending direction J. The end of the capturing region R2 in the forward feed direction F is located further in the reverse feed direction B than the end of the bed 11 in the forward feed direction F. The capturing region R2 includes an extension range of the needle plate (not shown). The capturing region R2 partially overlaps the projection region R1. The image sensor 57 is configured to detect a position in the projection region R1 designated by the pen 100, which is a pointing body and will be described later.

The movement device 40 includes the holder 43 to which the embroidery frame 50 that holds the sewing workpiece C is detachably attached. The movement device 40 is configured to move the holder 43 in the front-rear direction and the left-right direction with respect to the needle bar 6. One embroidery frame selected from a plurality of embroidery frames including the embroidery frame 50 is attachable to the movement device 40. The embroidery frame 50 includes a first frame 51 and a second frame 52, and the sheet-like sewing workpiece C is held between the first frame 51 and the second frame 52. The sewing workpiece C is a fabric, for example. The movement device 40 includes a main body 41 and a carriage 42. The carriage 42 includes the holder 43, a Y movement mechanism 47 and a Y motor 45 shown in FIG. 2. The holder 43 is provided on the right side surface of the carriage 42. The Y movement mechanism 47 moves the holder 43 in the front-rear direction, that is, in the Y direction. The Y motor 45 drives the Y movement mechanism 47. The main body 41 includes an X movement mechanism 46 and an X motor 44 shown in FIG. 2. The X movement mechanism 46 moves the carriage 42 in the left-right direction, that is, in the X direction. The X motor 44 drives the X movement mechanism 46. When embroidery sewing is performed using the embroidery frame 50, the movement device 40 moves the embroidery frame 50 attached to the holder 43 of the carriage 42 to a position indicated by a unique XY coordinate system, that is, an embroidery coordinate system.

The configuration of the pen 100 will be described with reference to the posture of FIG. 1. The pen 100 includes a main body 101, end portions 102, 104, a light emitter 103, and a switch 105. The main body 101 extends in a quadrangular prism shape. The end portions 102 and 104 constitute one end and the other end of the pen 100 in the longitudinal direction, respectively. The longitudinal direction of the pen 100 in FIG. 1 is the front-rear direction. The end portion 102 protrudes rearward from a rear end of the main body 101 in an L-shape. The light emitter 103 is provided at the end portion 102. The switch 105 is provided on a rear end part of the main body 101. The light emitter 103 emits light while the switch 105 is pressed. The switch 105 is operated to input various instructions via the image sensor 57 based on the projection image projected by the projector 58. Hereinafter, a pressing operation of the switch 105 by the user is referred to as a light emission operation. The user selects an object included in a projection image projected by the projector 58 by the light emission operation. The controller 2 of the sewing machine 1 shown in FIG. 2 recognizes the item selected in the projection image, based on a light emission position detected by the image sensor 57. The end portion 104 is formed at a front end of the main body 101, which is an end opposite to the end portion 102. The end portion 104 is operated to input various instructions via the touch screen 26.

An electrical configuration of the sewing machine 1 will be described with reference to FIG. 2. The controller 2 of the sewing machine 1 includes a CPU 81, a ROM 82, a RAM 83, the memory 84, and an input-output (I/O) interface 85. The CPU 81 is connected to the ROM 82, the RAM 83, the memory 84, and the input-output interface 85 via a bus 86.

The CPU 81 performs main control of the sewing machine 1, and performs various types of calculations and processes relating to sewing in accordance with various types of programs stored in the ROM 82. The ROM 82 includes a plurality of storage areas including a program storage area, which is not shown. The program storage area stores various programs for operating the sewing machine 1, including a program for performing a main process described later.

The RAM 83 is provided with a storage area for storing the operation result and so on of an operation process performed by the CPU 81. The memory 84 stores various parameters and so on for the sewing machine 1 to perform various processes. The memory 84 stores sewing data for sewing various sewing patterns that are sewable by the sewing machine 1, for each of a plurality of sewing patterns. The sewing data includes coordinate data. The coordinate data is data that indicates the formation positions of stitches included in the sewing pattern, that is, the positions of needle drop points, by the coordinates of the embroidery coordinate system. That is, the coordinate data includes data representing a plurality of coordinates for each needle drop point. The memory 84 stores, as frame type information 88, the correspondence between the type of embroidery frame that is attachable to the holder 43 and a sewing region. The sewing region is a region that is set inside the embroidery frame that is attached to the holder 43 of the sewing machine 1 and that is sewable. The memory 84 further stores a table 87 necessary for generating an image to be displayed on the LCD 15 in a main process described later and a projection image to be projected on the projection region R1 in a projection process. The table 87 stores display type objects F1 to F16 representing setting types of a sewing pattern, conditions for including the display type objects in a display image, and conditions for including projection setting objects corresponding to the display type objects in the projection image. The details of the table 87 will be described later.

The memory 84 further stores a coordinate system of the projector 58 (hereinafter, also referred to as "projection coordinate system"), a coordinate system of an image represented by the image data generated by the image sensor 57 (hereinafter, also referred to as "image coordinate system"), a coordinate system of the entire space (hereinafter, also referred to as "world coordinate system"), and the embroidery coordinate system. These coordinate systems are associated with one another in advance by parameters stored in the memory 84. Thus, the sewing machine 1 performs a process of identifying the coordinates in the projection coordinate system based on the sewing data, and a process of identifying the coordinates in the world coordinate system based on the image data. The sewing machine 1 is further performs a process of identifying the coordinates of the projection coordinate system based on the sewing data. For example, the sewing machine 1 projects a graphic that represents needle drop points onto positions of needle drop points on the sewing workpiece C that is held by the embroidery frame 50.

The input-output interface 85 is connected to drive circuits 91 to 96, the touch screen 26, the start-stop switch 29, the light source 56 of the projector 58, the imaging element 54 of the image sensor 57, and a detector 35. The light source 56 is turned on in accordance with a control signal from the CPU 81, and projects the projection image displayed on the reflective display device 59 onto the sewing workpiece C that is moved on the bed 11. The detector 35 is configured to detect that the embroidery frame is attached to the movement device 40 and to output a detection result corresponding to the type of the embroidery frame. The detector 35 detects the type of the embroidery frame in accordance with a combination of ON and OFF of a plurality of mechanical switches.

The sewing machine motor 33 is connected to the drive circuit 91. The drive circuit 91 drives the sewing machine motor 33 in accordance with a control signal from the CPU 81. The needle bar up-down movement mechanism 55 is driven via the main drive shaft 34 of the sewing machine 1 in accordance with the driving of the sewing machine motor 33, and the needle bar 6 moves up and down. A feed amount adjustment motor 22 is connected to the drive circuit 92. The drive circuit 93 drives the LCD 15 in accordance with a control signal from the CPU 81, thereby displaying an image on the LCD 15. The X motor 44 is connected to the drive circuit 94. The Y motor 45 is connected to the drive circuit 95. The drive circuits 94 and 95 drive the X motor 44 and the Y motor 45, respectively, in accordance with control signals from the CPU 81. In accordance with the driving of the X motor 44 and the Y motor 45, the embroidery frame 50 attached to the movement device 40 moves in the X direction and the Y direction by the movement amount corresponding to the control signal. The drive circuit 96 drives the reflective display device 59 of the projector 58 in accordance with a control signal from the CPU 81, and causes the reflective display device 59 to display a projection image.

The operation of the sewing machine 1 will be briefly described. When embroidery sewing is performed using the embroidery frame 50, the needle bar up-down movement mechanism 55 and the hook mechanism 28 are driven in conjunction with an operation in which the embroidery frame 50 is moved in the X direction and the Y direction by the movement device 40. In this way, a sewing pattern is sewn on the sewing workpiece C held by the embroidery frame 50 by the sewing needle 7 attached to the needle bar 6.

A use example of the projector 58 and the image sensor 57 will be described. The projector 58 is used, for example, for the user to check the position, the shape, and so on, of stitches formed on the sewing workpiece C before sewing. In this case, the projector 58 emits image light of a projection image indicating the sewing pattern selected by the user in accordance with an instruction of the user. The image light is projected onto the sewing workpiece C placed on the bed 11. In another example, the projector 58 is used for calibration of the projector 58 before shipment of the sewing machine 1. In this case, the projector 58 projects a particular calibration pattern in accordance with an instruction of the operator. The calibration pattern is, for example, grid lines arranged in a lattice shape. The image sensor 57 captures an image of the projected calibration pattern. The controller 2 of the sewing machine 1 detects the amount of distortion of the captured image and stores the amount of distortion in the memory 84. After shipment of the sewing machine 1, in response to detecting an instruction to project the image light of the projection image indicating the sewing pattern, the controller 2 adjusts the image light emitted from the projector 58 such that the distortion of the distortion amount stored in the memory 84 is corrected. The sewing machine 1 thereby projects image light of a projection image without distortion onto the sewing workpiece C. The use examples of the projector 58 and the image sensor 57 are not limited to the above, and the projector 58 and the image sensor 57 may be used for various other purposes.

An overview of the main process and the projection process started in the main process will be described with reference to FIG. 13. The sewing machine 1 is configured to, in response to selection of a setting object for instructing setting of a sewing pattern, perform setting of the sewing pattern by each of a first method and a second method. The first method is a method of performing the setting by using a display image displayed on the LCD 15 and the touch screen 26. In the first method, in response to detecting, by the touch screen 26, selection of a display setting object that is a setting object included in the display image, the sewing machine 1 performs setting of the sewing pattern. The second method is a method of performing the setting by using a projection image projected by the projector 58 and the image sensor 57. In the second method, in response to detecting, by the image sensor 57, selection of a projection setting object that is a setting object included in the projection image, the sewing machine 1 performs setting of the sewing pattern. The first method and the second method are different from each other in the types of executable settings and so on. The table 87 of FIG. 13 stores a correspondence between the first method and the second method. Hereinafter, the setting type (type of setting) is also referred to as an edit item. As shown in FIG. 13, the table 87 stores a projection setting object and a plurality of display type objects for selecting the setting type of the sewing pattern. The plurality of display type objects are displayed on the LCD 15.

The first method is performed in the main process. In the first method, the sewing machine 1 displays a display screen including the plurality of display type objects on the LCD 15, and receives a selection of a setting type. The setting types are, for example, the size, the sewing position, and the sewing angle of the sewing pattern. The sewing machine 1 displays, on the LCD 15, the display setting object corresponding to the display type object selected via the touch screen 26, and receives an instruction to perform setting of the sewing pattern.

The sewing machine 1 stores the display type objects F1 to F16 in the table 87. The display type object F1 is selected to input an instruction to change the size of the sewing pattern. The display type object F2 is selected to input an instruction to change the sewing position of the sewing pattern. The display type object F3 is selected to input an instruction to group the selected plurality of sewing patterns. The display type object F4 is selected to input an instruction to rotate the sewing pattern. The display type object F5 is selected to input an instruction to horizontally flip the sewing pattern. The display type object F6 is selected to input an instruction to copy the sewing pattern. The display type object F7 is selected to input an instruction to change the thread density of a frame pattern or a character pattern. The thread density is expressed by, for example, the number of stitches per unit length. The display type object F8 is selected to input an instruction to create a continuous pattern in which sewing patterns are continuously arranged in the X direction or the Y direction. The display type object F9 is selected to input an instruction to sew the outline of the selected sewing pattern and create an applique piece.

The display type object F10 is selected to input an instruction to change the color of the displayed sewing pattern. The display type object F11 is selected to input an instruction to edit characters. The display type object F12 is selected to input an instruction to arrange a plurality of sewing patterns to be aligned at a reference position. The display type object F13 is selected to input an instruction to form stitches of a stippling pattern around the sewing pattern. The stippling pattern is one of quilting patterns in which a filler is inserted between a front fabric and a back fabric and the front fabric and the back fabric are sewn together with a straight line, a curved line, and so on. The display type object F14 is selected to input an instruction to extract the outline of the sewing pattern. The display type object F15 is selected to input an instruction to change the overlapping order of a plurality of sewing patterns. The display type object F16 is selected to input an instruction to perform setting of not sewing.

The column of "display image" of the table 87 indicates display conditions of the display type objects. In the "display image" column, "YES" indicates that the setting corresponding to the display type object is executable and that the display type object is displayed on the LCD 15. In the "display image" column, "NO" indicates that execution of the setting corresponding to the display type object is restricted and that the display type object is not displayed on the LCD 15. In the first method, the type of executable setting changes depending on whether projection is being performed.

The second method is performed in a projection process that is started in the main process. In the second method, without projecting a projection image that shows a list of the setting types, the sewing machine 1 projects a projection image that includes a projection setting object for one setting type that is read out in accordance with "projection order" in "projection image" column, and receives an instruction to perform setting of the sewing pattern. In the "projection order" of the "projection image" column, "NO" indicates that execution of the setting corresponding to the display type object is restricted (disabled). In the sewing machine 1 of the present example, among the display type objects F1 to F16 included in the display type object FP, the display setting objects corresponding to the display type objects F1, F2, and F4 are projected. That is, the setting types that are executable by the second method are the size, the sewing position, and the sewing angle of the sewing pattern. The number of setting types executable by the second method is three, which is smaller than the number of setting types executable by the first method, that is, sixteen.

The main process will be described with reference to FIGS. 3 to 12. In the main process, the controller 2 edits sewing data of the selected sewing pattern, and performs a process of sewing the sewing pattern on the sewing workpiece C held by the embroidery frame 50 in accordance with the edited sewing data. The user selects one or more sewing patterns of the sewing target from a plurality of types of sewing patterns represented by sewing data stored in advance in the memory 84 shown in FIG. 2, and inputs a start command to start the main process. In response to detecting the start instruction, the controller 2 reads the program for performing the main process stored in the program storage area of the ROM 82 to the RAM 83. The controller 2 performs the following steps in accordance with instructions included in the program read out to the RAM 83. Various parameters necessary for performing the main process are stored in the memory 84. Various information acquired in the main process is stored in the RAM 83 as appropriate. Hereinafter, step is abbreviated as "S". In FIGS. 4 to 7, the arrangement of the sewing pattern is shown assuming that the left-right direction and the upper-lower direction of the display image displayed on the LCD 15 corresponding to the X direction and the Y direction of the embroidery coordinate system, respectively.

Figure 4:
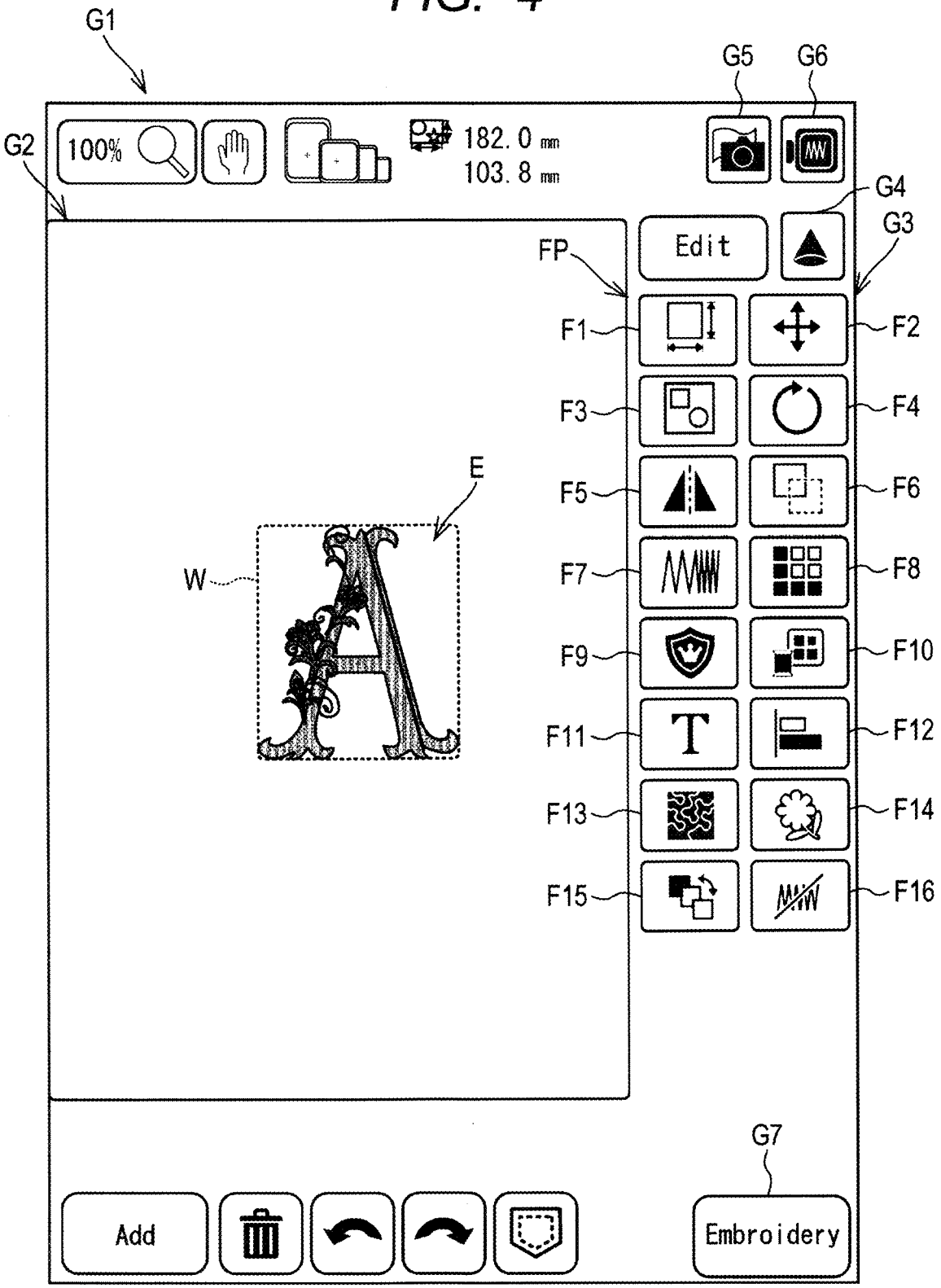
FIG. 4 is an explanatory diagram of a first display image G1.

As a specific example, a case will be described in which the sewing pattern represented by a pattern image E shown in FIG. 4 is selected as one or more sewing patterns of the sewing target. The sewing pattern represented by the pattern image E is a sewing pattern that is sewn using thread spools of seven different colors and that is a combination of the alphabet "A" and a flower sewing pattern. In FIGS. 4 to 7, objects corresponding to the same processes among the objects included in the projection image are denoted by the same reference numerals. The objects are images used for inputting various instructions. In the main process, the controller 2 performs processes corresponding to the object selected by the pen 100.

Figure 3:
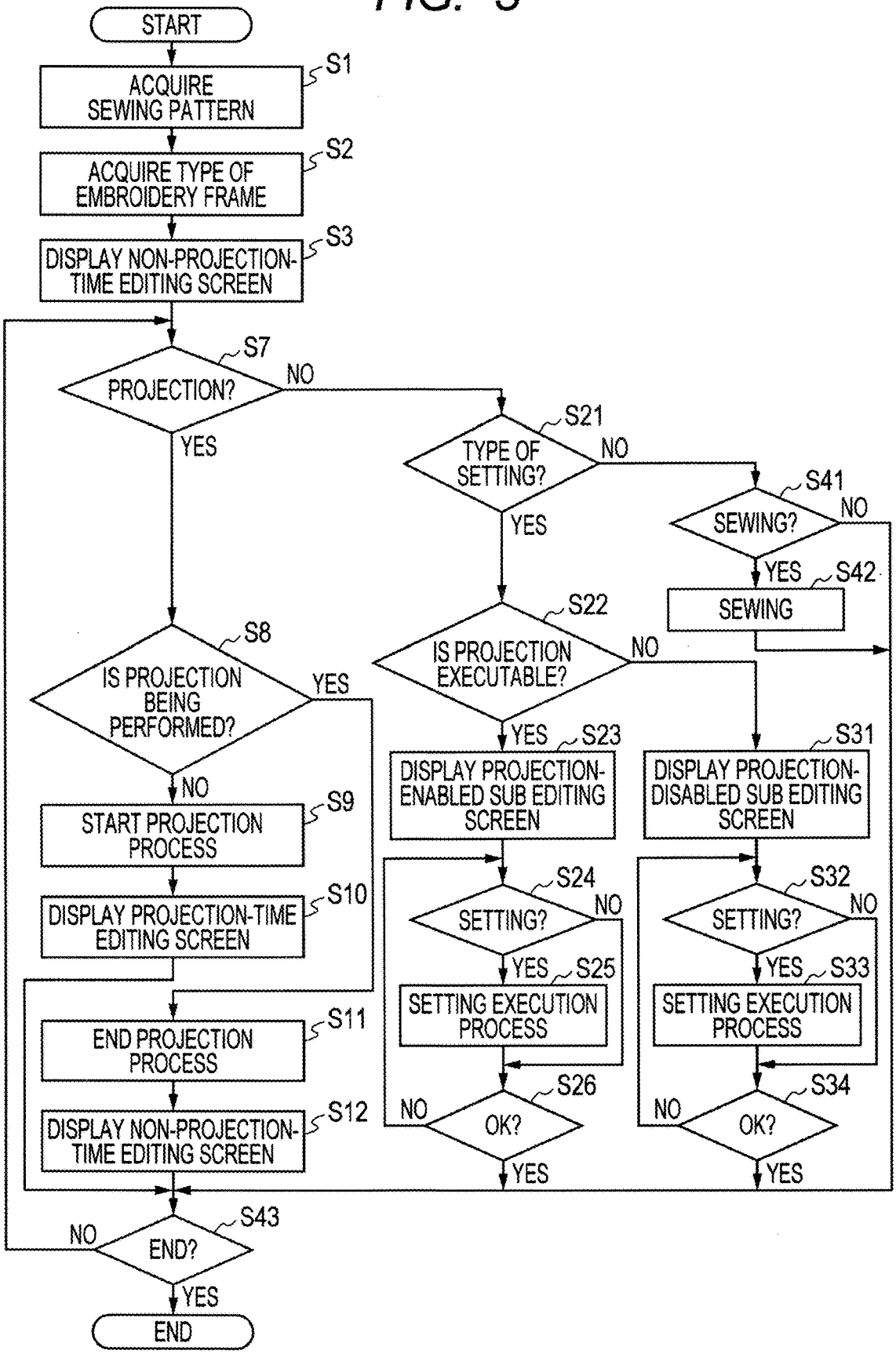
FIG. 3 is a flowchart of a main process.

As shown in FIG. 3, the controller 2 acquires the sewing pattern designated by the user from the plurality of types of sewing patterns stored in the memory 84 (S1). The sewing pattern acquired in S1 is also referred to as a selected pattern. The controller 2 acquires the type of the embroidery frame 50 (S2). The controller 2 may acquire the type of the embroidery frame 50 based on the detection result of the detector 35, or may acquire the type of the embroidery frame 50 based on the detection result of a panel operation. The controller 2 acquires the frame type information 88 that is the size of the sewing region corresponding to the type of the embroidery frame 50.

The controller 2 refers to the table 87 of FIG. 13, and displays, on the LCD 15, a first display image G1 including the plurality of display type objects during a period in which the projection process by the projector 58 is not performed (S3). The controller 2 performs setting of the sewing pattern in accordance with the display type object selected using the touch screen 26 from the plurality of display type objects displayed on the LCD 15.

As shown in FIG. 4, the first display image G1 includes fields G2, G3, and objects G4 to G7. The field G2 displays the pattern image E that represents stitches that are formed when the sewing pattern acquired in S1 is sewn, and a rectangle W that represents the size of the sewing pattern acquired in S1. The size of the field G2 corresponds to the size of the sewing region acquired in S2. The rectangle W is the smallest rectangle that encompasses the sewing pattern acquired in S1. The field G3 displays a plurality of display type objects for designating the setting type of the sewing pattern represented by the pattern image E displayed in the field G2, that is, the editing item. The field G3 displays the display type objects F1 to F16 corresponding to sixteen setting types based on the table 87. The display type objects F1 to F16 are also collectively referred to as a display type object FP. The display type objects F1 to F16 are stored in the "display image" column and the "projection is not being performed" field of the table 87 in association with "YES". Thus, the first display image G1 displayed in S3 in which projection is not being performed includes each of the display type objects F1 to F16.

The object G4 is selected to input an instruction to project a projection image by the projector 58. The object G5 is selected to input an instruction to capture an image of the sewing workpiece C held by the embroidery frame 50 by the image sensor 57 and to perform the alignment (positioning) of the sewing pattern. The object G6 is selected to input an instruction to display a preview of an image representing a finished image of the sewing pattern. The object G7 is selected to input an instruction to display a sewing screen.

The controller 2 determines whether selection of the object G4 is detected (S7). In response to not detecting selection of the object G4 (S7: NO), the controller 2 determines whether selection of any one of the display type objects F1 to F16 displayed in the field G3 is detected (S21). In response to detecting selection of the display type object F1 (S21: YES), the controller 2 refers to the table 87 and determines the setting type corresponding to the display type object F1 detected in S21, that is, whether the projection process is executable to perform setting of the editing item (S22). The projection process is executable for the setting type for which "YES" is set in the "projection is being performed" in the "display image" column of the table 87, and the projection process is not executable for the setting type for which "NO" is set. Since the display type object F1 corresponds to the setting type that is executable (S22: YES), the controller 2 displays a sub editing image G10 in which the object G4 is enabled as a sub editing screen corresponding to the display type object F1 (S23).

Figure 5:
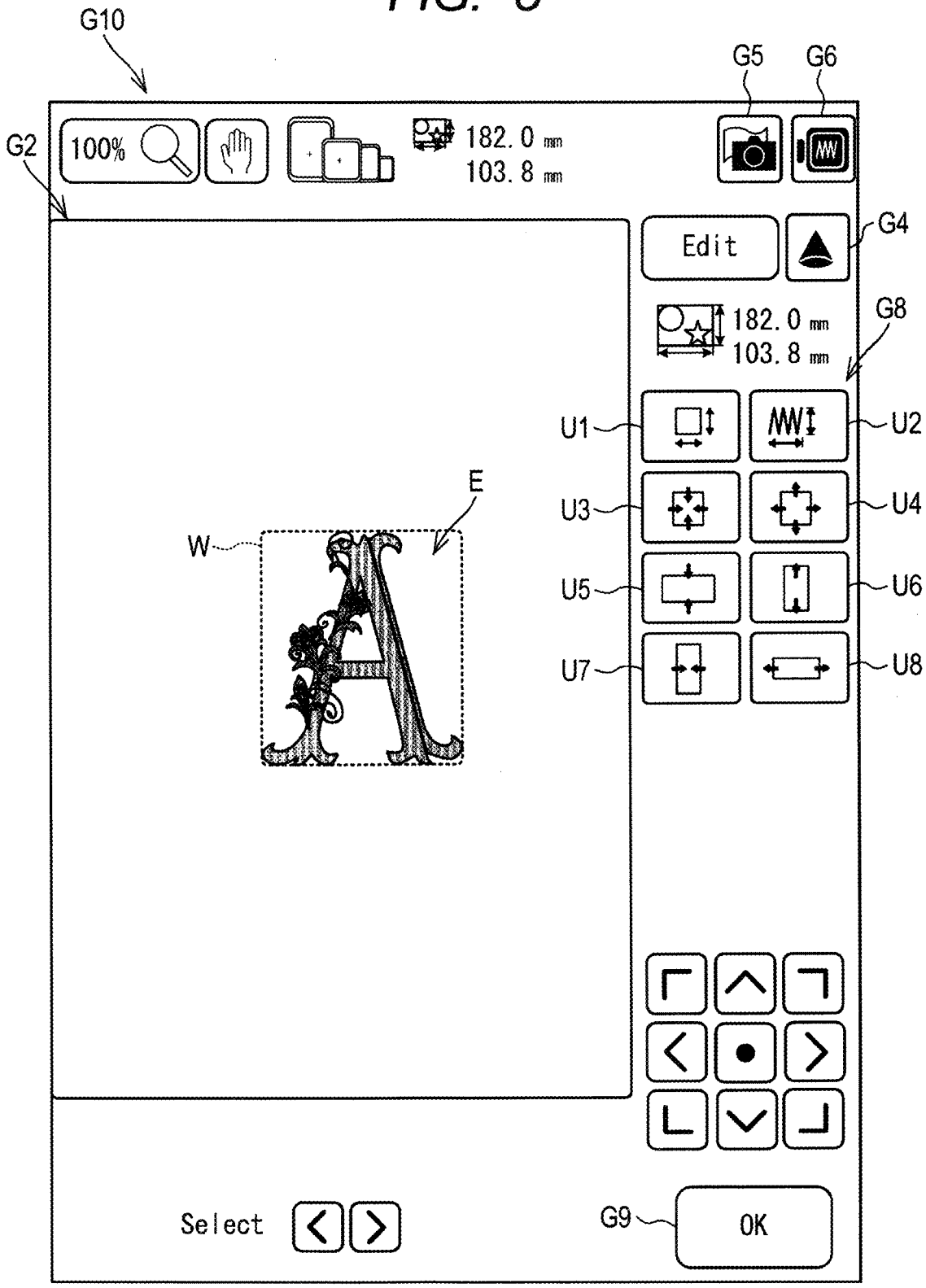
FIG. 5 is an explanatory diagram of a sub editing image G10.

As shown in FIG. 5, the sub editing image G10 includes a field G8 and an object G9 in addition to the field G2 and the objects G4 to G6 similar to those of the first display image G1. Since the sub editing image G10 includes the object G4, the user is allowed to input an instruction to perform the projection process in the sub editing image G10. The field G8 displays display setting objects for inputting an instruction to change the size of the sewing pattern, which is the setting type corresponding to the display type object F1. The field G8 displays display setting objects U1 to U8.

The display setting object U1 is selected to input an instruction to change the size of the sewing pattern while maintaining the number of stitches. The display setting object U2 is selected to input an instruction to change the size of the sewing pattern while maintaining the thread density. The display setting object U3 is selected to input an instruction to reduce the sewing pattern in the left-right direction and the front-rear direction at the same magnification. The display setting object U4 is selected to input an instruction to enlarge the sewing pattern in the left-right direction and the front-rear direction at the same magnification. The display setting object U5 is selected to input an instruction to reduce the size of the sewing pattern in the front-rear direction while keeping the size of the sewing pattern in the left-right direction constant. The display setting object U6 is selected to input an instruction to enlarge the sewing pattern in the front-rear direction while keeping the size of the sewing pattern in the left-right direction constant. The display setting object U7 is selected to input an instruction to reduce the size of the sewing pattern in the left-right direction while keeping the size of the sewing pattern in the front-rear direction constant. The display setting object U8 is selected to input an instruction to enlarge the sewing pattern in the left-right direction while keeping the size of the sewing pattern in the front-rear direction constant. The object G9 is selected to input an instruction to finish the process of changing the size of the sewing pattern, which is the setting type corresponding to the display type object F1 and return to the editing screen that was displayed when S21 was performed.

The controller 2 determines whether selection of any one of the display setting objects U1 to U8 displayed in the field G8 is detected (S24). In response to detecting selection of any one of the display setting objects U1 to U8 (S24: YES), the controller 2 performs the setting corresponding to the display setting object of which selection is detected in S24 (S25). In response to detecting none of the display setting objects U1 to U8 (S24: NO), or after S25, the controller 2 determines whether selection of the object G9 is detected (S26). In response to not detecting selection of the object G9 (S26: NO), the controller 2 returns the processing to S24. In response to detecting selection of the object G9 (S26: YES), the controller 2 displays, on the LCD15, the editing screen displayed at the time of execution of S21 among the editing screen in a case where the projection process is not performed and the editing screen in a case where the projection process is performed, and performs S43. A pattern image is displayed in the field G2 of the editing screen displayed in a case where selection of the object G9 is detected. In the pattern image, the setting in S25 is reflected.

In S21, in response to detecting selection of the display type object F10 (S21: YES), since the display type object F10 corresponds to the setting type for not performing the projection process (S22: NO), the controller 2 refers to the memory 84 and displays a sub editing image G20 in which the object G4 is disabled as the sub editing screen corresponding to the display type object F10 (S31).

Figure 6:
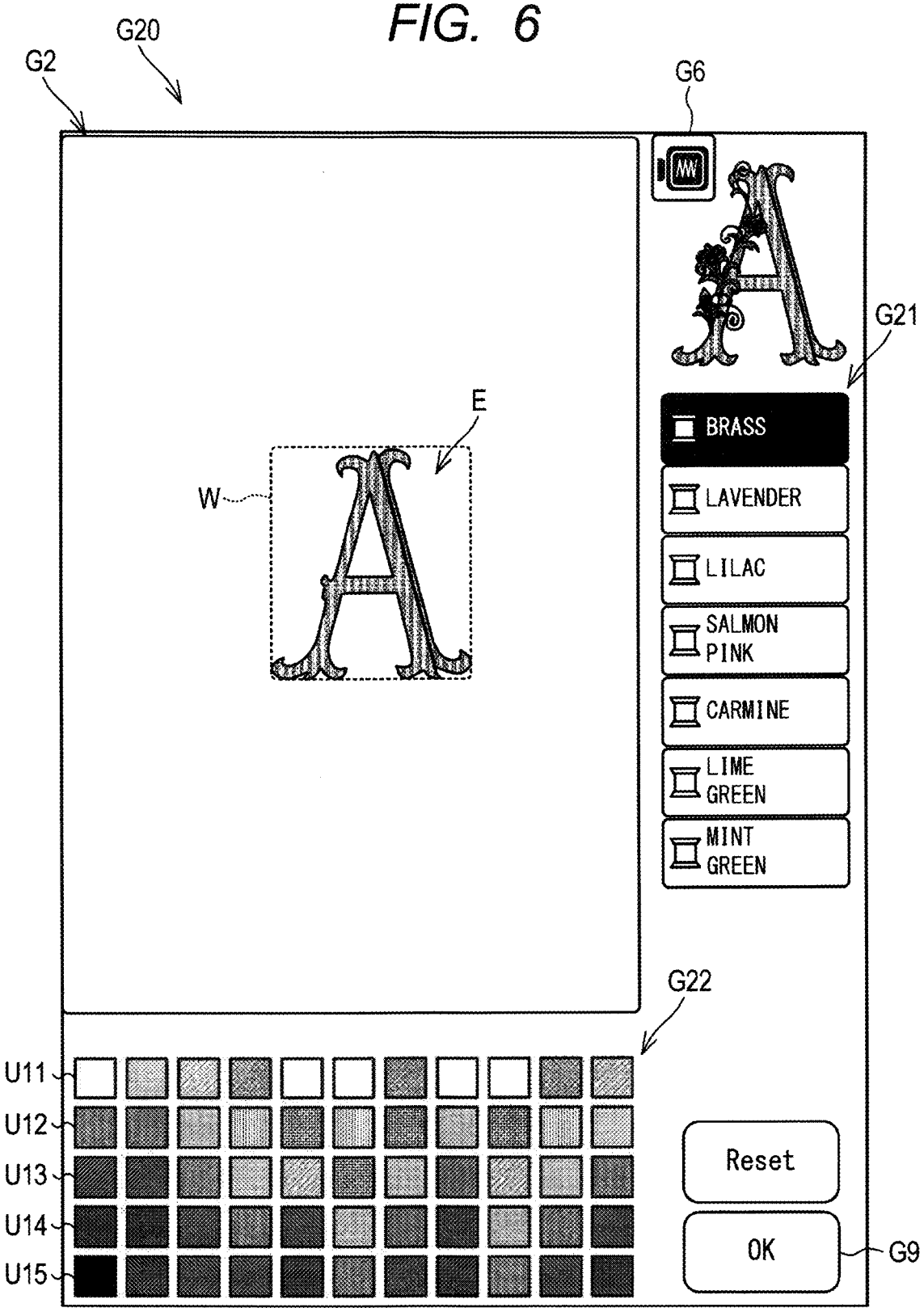
FIG. 6 is an explanatory diagram of a sub editing image G20.

As shown in FIG. 6, the sub editing image G20 includes fields G21, G22 and the object G9, in addition to the field G2 and the object G6 similar to those of the first display image G1. Since the sub editing image G20 does not include the object G4, the user is not allowed to input an instruction to perform the projection process in the sub editing image G20. The field G21 displays the thread colors of partial patterns constituting the sewing pattern represented by the pattern image E displayed in the field G2 from top to bottom in the order of sewing. The field G21 displays seven thread colors corresponding to the seven partial patterns, and the color of the field displaying the thread color of the selected partial pattern is changed to a color different from the color of the fields displaying the thread colors of unselected partial patterns. The field G22 displays a plurality of display setting objects including display setting objects U11, U12, U13, U14 and U15 for setting candidates of the thread color of the partial pattern being selected in the field G21. By selecting the display setting object of a desired thread color from the thread colors that are displayed in the field G22, the user sets the thread color of the partial pattern that is being selected in the field G21.

The controller 2 determines whether selection of any of the display setting objects for the plurality of thread colors displayed in the field G22 is detected (S32). In response to detecting selection of any of the plurality of display setting objects (S32: YES), the controller 2 performs the setting corresponding to the display setting object of which the selection is detected in S32 (S33). Specifically, the controller 2 sets the thread color of the display setting object selected in S32 as the thread color of the selected partial pattern. In response to not detecting selection of any of the plurality of display setting objects (S32: NO), or after S33, the controller 2 determines whether selection of the object G9 is detected (S34). In response to not detecting selection of the object G9 (S34: NO), the controller 2 returns the processing to S32. In response to detecting selection of the object G9 (S34: YES), the controller 2 displays, on the LCD 15, the editing screen displayed at the time of execution of S21 among the editing screen in a case where the projection process is not performed and the editing screen in a case where the projection process is performed, and performs S43. A pattern image is displayed in the field G2 of the editing screen displayed when selection of the object G9 is detected. In the pattern image, the setting in S33 is reflected.

In response to detecting selection of the object G4 (S7: YES), the controller 2 determines whether the projection image is being projected by the projector 58 (S8). When the projection image is not being projected (S8: NO), the controller 2 starts the projection process described later (S9), refers to the table 87 of the memory 84, and displays, on the LCD 15, a second display image G30 during a period in which the projection image is being projected ("projection-time editing screen") (S10). The second display image G30 includes a part of the plurality of display type objects included in the first display image G1. When the display image is displayed and the projection image is projected, the sewing machine 1 accepts both setting by the display type objects and setting by the projection type objects. That is, the user can perform setting either on the display image or on the projection image, whichever he or she likes. In this case, when setting of the pattern image E (the position, size, and so on) is changed in one of the display image and the projection image, the setting is reflected in the other one of the display image and the projection image.

Figure 7:
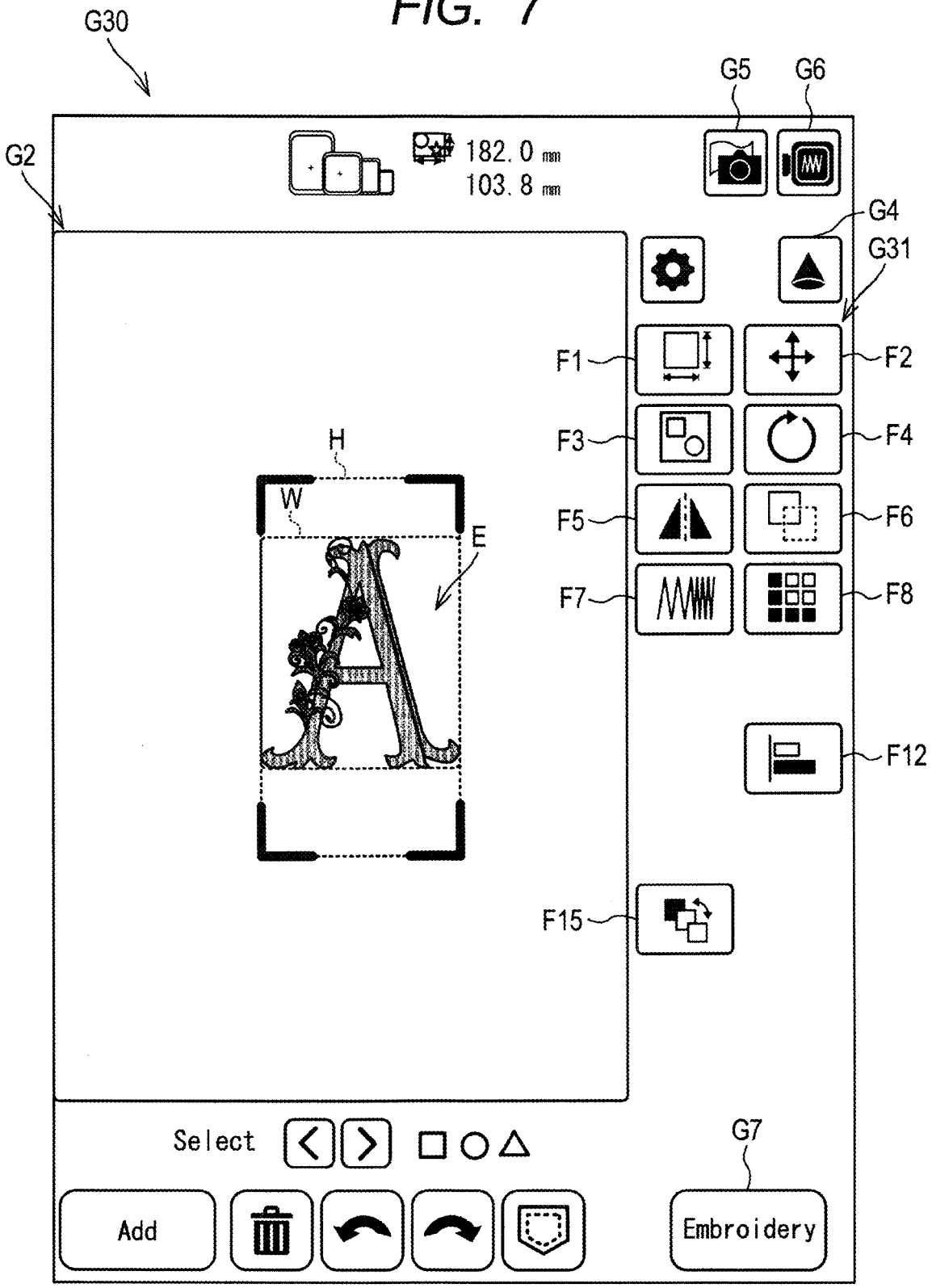
FIG. 7 is an explanatory diagram of a second display image G30.

As shown in the "display image" and "projection is being performed" column of the table 87 of FIG. 13, the display type objects F9 to F11, F13, F14, and F16 among the display type objects F1 to F16 included in the display type object FP are associated with "NO", and the remaining display type objects are associated with "YES". As shown in FIG. 7, the second display image G30 includes a field G31 in addition to the field G2 and the objects G4, G7 similar to those of the first display image G1. The field G2 displays a projection range H in addition to the pattern image E. The display type objects displayed in the field G31 are a part of the sixteen display type objects displayed in the first display image G1, and are the display type objects F1 to F8, F12, and F15 associated with "YES" in the "display image" and "projection is being performed" column of the table 87. The display type objects F9 to F11, F13, F14, and F16 are associated with "NO" in the "display image" and "projection is being performed" column of the table 87, and are not displayed in the second display image G30.

When the projection image is being projected (S8: YES), the controller 2 ends the projection process described later (S11), and displays an editing screen for a case where the projection process is not being performed ("non-projection-time editing screen") (S12). After S10 or S12, the controller 2 determines whether an end instruction to end the main process is detected (S43). The end instruction is input, for example, when the power of the sewing machine 1 is turned off. In response to not detecting the end instruction (S43: NO), the controller 2 returns the processing to S7. In response to detecting the end instruction (S43: YES), the controller 2 ends the main process.

In response to not detecting selection of the display type object (S21: NO), the controller 2 determines whether a sewing start instruction to start sewing is detected (S41). The controller 2 determines that the sewing start instruction is detected when selection of the start-stop switch 29 is detected. In response to detecting the sewing start instruction (S41: YES), the controller 2 controls the movement device 40 and the needle bar 6 to sew the sewing pattern represented by the pattern image E on the sewing workpiece C (S42). In response to not detecting the sewing start instruction (S41: NO), or after S42, the controller 2 performs S43.

The projection process started in the main process of FIG. 3 will be described with reference to FIGS. 8 to 12. In the projection process, the controller 2 projects a pattern image representing the selected sewing pattern onto the projection region R1, and receives an instruction to perform setting of the sewing pattern. In response to detecting a projection start instruction in S7, the controller 2 reads the program for performing the projection process stored in the program storage area of the ROM 82 to the RAM 83. The controller 2 performs the following steps in accordance with instructions included in the program read out to the RAM 83. Various parameters necessary for performing the projection process are stored in the memory 84. Various data acquired in the projection process are stored in the RAM 83 as appropriate. Hereinafter, step is abbreviated as "S". In FIGS. 9A to 12D, the size of the projection image corresponds to the size of the projection region R1, and the arrangement of the projection image is shown assuming that the left-right direction and the upper-lower direction of the drawings correspond to the X direction and the Y direction of the embroidery coordinate system, respectively. Among the objects included in the projection image, the objects corresponding to the same process are denoted by the same reference numerals. In the following description, various image data to be processed by the controller 2 are simply referred to as an image, a captured image, or a projection image.

Figure 8:
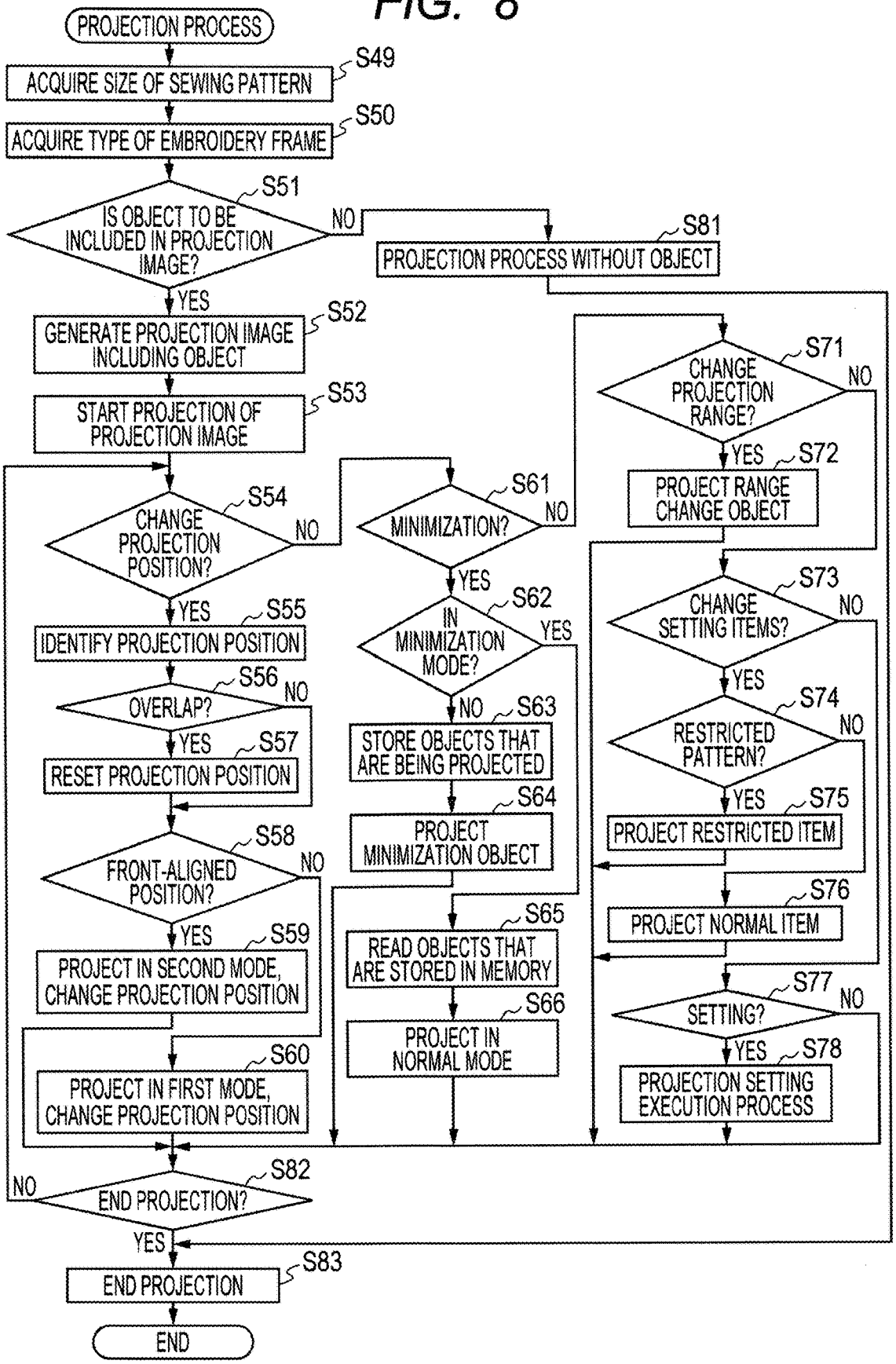
FIG. 8 is a flowchart of a projection process.

As shown in FIG. 8, the controller 2 performs a size acquisition process of acquiring the size of the sewing pattern (S49). As the size of the sewing pattern represented by the pattern image E, the controller 2 acquires the length of the rectangle W in the left-right direction and the length of the rectangle W in the front-rear direction. The controller 2 performs the type acquisition process of acquiring the type of the embroidery frame 50 that is attached to the holder 43 in a similar manner to S2 (S50).

The controller 2 determines whether to include a projection setting object in the projection image (S51). The controller 2 includes the projection setting object in the projection image in a case where a particular condition is satisfied. The particular condition may be set as appropriate. For example, the particular condition of at least specific example 1 or 2 may be set as described below.

The particular condition of the specific example 1 is that a projection image including the pattern image and the projection setting object is projected when the type of the embroidery frame 50 acquired in S50 is a particular type, and a projection image including the pattern image and not including the projection setting object is projected when the type of the embroidery frame 50 is not the particular type. More specifically, the particular condition of the specific example 1 is that it is determined that the region surrounded by the embroidery frame is larger than a particular size, based on the type of embroidery frame acquired in S50 and on the size of the embroidery region corresponding to the type of embroidery frame stored in the memory 84.

The particular condition of the specific example 2 is that a projection image including the pattern image and the projection setting object is projected when the size of the sewing pattern acquired in S49 and the size of the projection region R1 stored in the memory 84 satisfy a particular relationship, and a projection image including the pattern image and not including the projection setting object is projected when the size of the sewing pattern and the size of the projection region R1 do not satisfy the particular relationship. More specifically, the particular condition of the specific example 2 is that it is determined that the size of the sewing pattern is within the projection region R1.

In response to determining that the particular condition is not satisfied and thus the projection setting object is not to be included in the projection image (S51: NO), the controller 2 performs the projection process of projecting a projection image including the sewing pattern acquired in S1 and not including the projection setting object onto the projection region R1 (S81). In this case, the controller 2 performs a process of editing the sewing pattern based on the detection result of the panel operation, but does not perform a process of editing the sewing pattern based on the detection result of the light emission operation. In response to detecting an end instruction, the controller 2 ends projection by the projector 58 (S83), and ends the projection process.

In either of the specific examples 1 and 2, in response to determining that the projection setting object is to be included in the projection image (S51: YES), the controller 2 generates the projection image including the projection setting object (S52), and starts a projection process of projecting the projection image including the pattern image E representing the sewing pattern and the projection setting object for instructing the setting of the sewing pattern onto the bed 11 by the projector 58 and an image capturing process of acquiring the captured image by the image sensor 57 (S53).

Figure 9A:
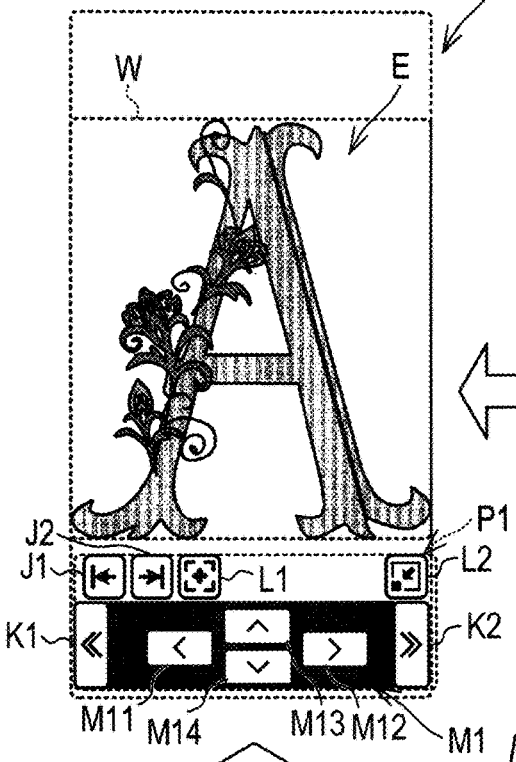
FIGS. 9A, 9B, 9C and 9D are explanatory diagrams of projection images projected on a projection region R1.

As shown in FIG. 9A, a projection image Q1 projected on the projection region R1 in S53 includes the pattern image E and the rectangle W, and position designation objects J1, J2, objects L1, K1, K2, a minimization object L2, and a projection setting object M1 in an object area P1. The pattern image E represents the shape of the stitches of the sewing pattern acquired in S1. The pattern image E is represented by a color image corresponding to the thread color. The pattern image E is projected at a planned sewing position with planned sewing size and sewing angle. The object area P1 is a minimum rectangle that includes the position designation objects J1, J2, the objects L1, K1, K2, the minimization object L2, and the projection setting object M1, and is longer in the left-right direction than in the front-rear direction. That is, the longitudinal direction of the object area P1 is the left-right direction, and the short direction of the object area P1 is the front-rear direction.

The position designation objects J1, J2 are selected to designate the projection position of the object area within the projection region R1. The controller 2 selects the projection position of the object area in the projection region R1 from a right-aligned position, a front-aligned position, and a left-aligned position. The controller 2 switches the arrangement of the plurality of projection setting objects in the projection image between a first mode and a second mode. In the first mode, the plurality of projection setting objects are arranged in the projection image such that the longitudinal direction of the object area in which the plurality of projection setting objects are arranged coincides with the longitudinal direction of the projection image. When the projection position of the object area in the projection region R1 is the right-aligned position or the left-aligned position, the controller 2 arranges the object area in the first mode. More specifically, when the projection position of the object area in the projection region R1 is the left-aligned position, the object area is arranged at a front left portion of the projection region R1. When the projection position of the object area in the projection region R1 is the right-aligned position, the object area is arranged at a front right portion of the projection region R1. In the second mode, the plurality of projection setting objects are arranged in the projection image such that the longitudinal direction of the object area coincides with the short direction of the projection image. When the projection position of the object area in the projection region R1 is the front-aligned position, the controller 2 arranges the object area in the second mode. In the projection image Q1 of FIG. 9A, the object area P1 is arranged at the front-aligned position in the second mode. The position designation object J1 is selected to input an instruction to set the object area to the left-aligned position, and the position designation object J2 is selected to input an instruction to set the object area to the right-aligned position. The projection image Q1 may include a position designation object which is selected to input an instruction to set the object area to the front-aligned position, which is the projection position of the object area that is being projected.

Figure 9B:
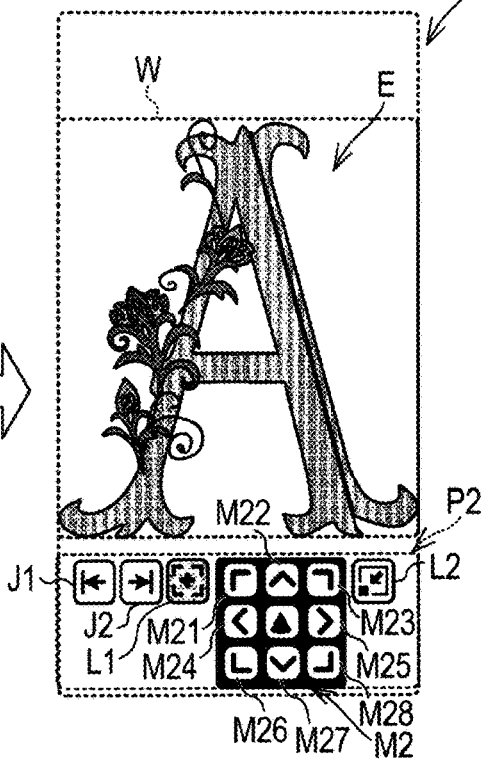

As shown in FIG. 9B, the object L1 is selected to input an instruction to switch between a mode in which a range change object M2 instructing the movement of the projection range H is projected and a mode in which the projection setting object M1, M3 or M4 for editing the sewing pattern is projected. The minimization object L2 is selected to input an instruction to switch between a normal mode and a minimization mode. The normal mode is a mode of projecting a projection image including the pattern image E, the projection setting object, and the minimization object L2. The minimization mode is a mode of projecting a projection image including the pattern image E and the minimization object L2 without including the projection setting object. The objects (switch objects) K1 and K2 are selected to switch a plurality of projection setting objects included in the projection image in accordance with a projection order. The projection order is indicated by numbers in the "projection image" and "projection order" column in the table 87 of FIG. 13. The projection setting object M1 corresponding to the display type object F2 is the first in the projection order. A projection setting object M3 corresponding to the display type object F1 is the second in the projection order. A projection setting object M4 corresponding to the display type object F4 is the third in the projection order. The object K1 is selected to project the projection setting object of the setting type that is one before the current setting type in the projection order. The object K2 is selected to project the projection setting object of the setting type that is one after the current setting type in the projection order.

Figure 9C:
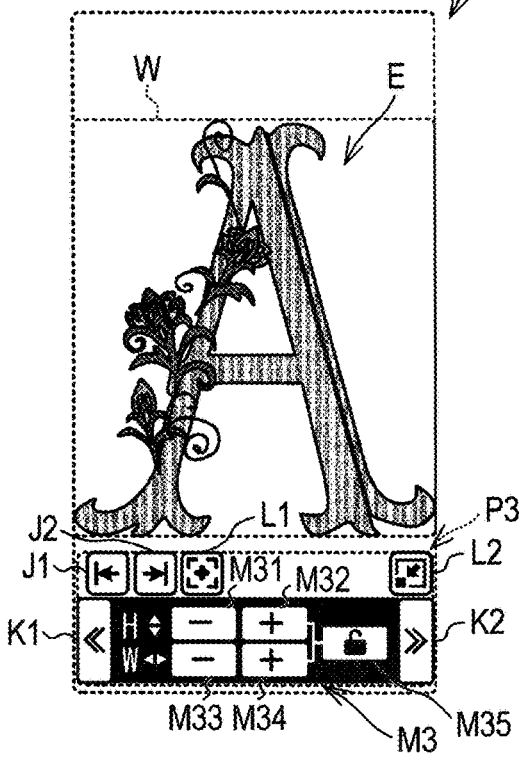
Figure 9D:
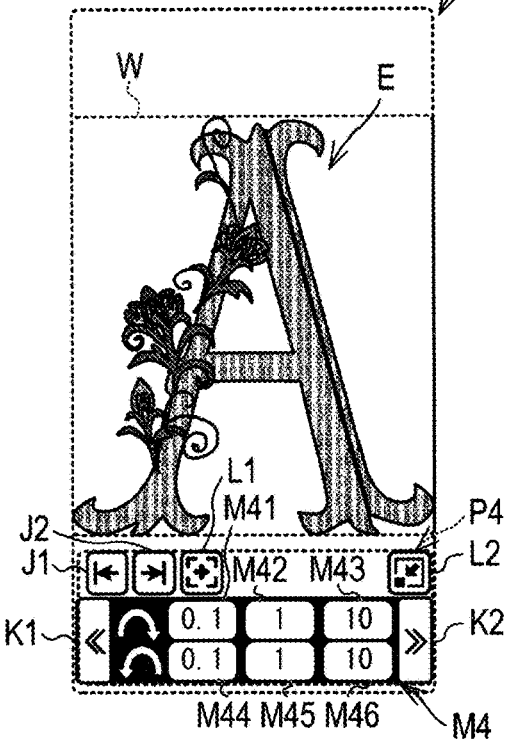

As shown in FIG. 9A, the projection setting object M1 includes projection setting objects M11, M12, M13 and M14 that indicate the movement direction of the sewing pattern. As shown in FIG. 9C, the projection setting object M3 includes projection setting objects M31 and M32 for setting the size of the sewing pattern in the front-rear direction, projection setting objects M33 and M34 for setting the size of the sewing pattern in the left-right direction, and a projection setting object M35 for switching whether to individually set the size of the sewing pattern in the front-rear direction and the size of the sewing pattern in the left-right direction. The projection setting object M3 is used to input settings corresponding to the display setting objects U3 to U8 displayed in the sub editing image G10 of FIG. 5. In the present example, the setting objects and the method of setting the size of the sewing pattern in the left-right direction differ between the case of using the display image and the case of using the projection image. As shown in FIG. 9D, the projection setting object M4 includes projection setting objects M41, M42 and M43 that designate a rotation angle in the clockwise direction in a plan view, and projection setting objects M44, M45 and M46 that designate a rotation angle in the counterclockwise direction in a plan view.

Based on the captured image captured by the image sensor 57, the controller 2 determines whether selection of the position designation object J1 or the position designation object J2 is detected (S54). When light emission by the pen 100 is detected at a position where the position designation object J1 or the position designation object J2 is projected in the captured image, the controller 2 determines that selection of the position designation object J1 or the position designation object J2 is detected. When selection of neither the position designation object J1 nor J2 is detected (S54: NO), the controller 2 determines whether selection of the minimization object L2 is detected based on the captured image captured by the image sensor 57 (S61). In response to detecting light emission by the pen 100 at a position where the minimization object L2 is projected in the captured image, the controller 2 determines that selection of the minimization object L2 is detected. In response to not detecting selection of the minimization object L2 (S61: NO), the controller 2 determines whether selection of the object L1 is detected (S71). In response to detecting selection of the object L1 (S71: YES), the controller 2 projects a projection image Q2 shown in FIG. 9B in an object area P2 (S72). The projection image Q2 includes the position designation objects J1, J2, the object L1, the minimization object L2, and the range change object M2. The color of the object L1 is a color indicating that the object L1 is selected, and is a color different from the case where the object L1 is not selected as shown in FIG. 9A. The longitudinal direction of the object area P2 is the left-right direction, and the short direction of the object area P2 is the front-rear direction. The range change object M2 includes objects M21, M22, M23, M24, M25, M26, M27 and M28 indicating movement directions of the projection range H. The user selects a desired object from the objects M21 to M28 by a light emission operation to instruct the change of the projection range H. In response to detecting selection of any one of the objects M21 to M28, the controller 2 changes the projection range H in accordance with the selected object, and moves the embroidery frame 50 such that the changed projection range H matches the projection region R1. In other words, the controller 2 moves the embroidery frame 50 such that the changed projection range H is projected on the projection region R1. The controller 2 performs S82 described later.

In response to not detecting selection of the object L1 (S71: NO), the controller 2 determines whether selection of the object K1 or the object K2 is detected (S73). In response to detecting selection of the object K1 or the object K2 (S73: YES), the controller 2 determines whether the sewing pattern is a restricted pattern (S74). As shown in FIG. 13, in a case where the sewing pattern is a grouped sewing pattern or a plurality of sewing patterns (multiple sewing patterns) stored as restricted patterns in the table 87, the controller 2 determines that the sewing pattern is a restricted pattern. In a case where the sewing pattern is a restricted pattern (S74: YES), the controller 2 refers to the table 87 shown in FIG. 13 and projects a projection image that includes a restricted item (S75). The restricted item is determined in accordance with the type of restricted pattern and the setting type. In a case where the restricted pattern is a plurality of sewing patterns (multiple patterns), the controller 2 projects the projection setting objects of the setting types corresponding to the display type objects F1 and F4 in a mode different from the normal mode, and does not accept selection of the projection setting objects. In a case where the restricted pattern is a grouped sewing pattern, the controller 2 projects the projection setting objects of the setting type corresponding to the display type object F1 in a mode different from the normal mode, and does not accept selection of the projection setting objects. In a case where the restricted pattern is the grouped sewing pattern, the controller 2 projects a part of the projection setting objects of the setting type corresponding to the display type object F4 in a mode different from the normal mode, and does not accept selection of the part of the projection setting objects. In a case where the sewing pattern is the restricted pattern, the controller 2 projects the projection setting objects of the setting type corresponding to the display type object F2 in the same mode as the normal mode, and accepts selection of the projection setting objects.

In a case where the sewing pattern is not the restricted pattern (S74: NO), the controller 2 projects the normal item (S76). In response to detecting selection of the object K2 in a state where the projection image Q1 shown in FIG. 9A is projected (S73: YES, S74: NO), the controller 2 projects a projection image Q3 shown in FIG. 9C. The projection image Q3 includes the pattern image E, the rectangle W, and the position designation objects J1, J2, the objects L1, K1, K2, the minimization object L2, and the projection setting object M3 in an object area P3. The longitudinal direction of the object area P3 is the left-right direction, and the short direction of the object area P3 is the front-rear direction. In response to detecting selection of the object K1 in a state where the projection image Q1 shown in FIG. 9A is projected (S73: YES, S74: NO), the controller 2 projects a projection image Q4 shown in FIG. 9D. The projection image Q4 includes the pattern image E, the rectangle W, and the position designation objects J1, J2, the objects L1, K1, K2, the minimization object L2, and the projection setting object M4 in an object area P4. The longitudinal direction of the object area P4 is the left-right direction, and the short direction of the object area P4 is the front-rear direction. After S75 or S76, the controller 2 performs S82 described later.

In response to not detecting selection of the object K1 or the object K2 (S73: NO), the controller 2 determines whether selection of the projection setting object is detected based on the captured image captured by the image sensor 57 (S77). In response to detecting light emission by the pen 100 at a position where the projection setting object is projected in the captured image, the controller 2 determines that selection of the projection setting object is detected. In response to detecting selection of the projection setting object (S77: YES), the controller 2 performs a projection setting execution process of performing setting the sewing pattern in response to selection of the projection setting object during a period in which the projection image is being projected (S78). In response to detecting the position at which the projection setting object is projected by the image sensor 57, the controller 2 performs setting of the sewing pattern. In S78, the controller 2 sets the size of the sewing pattern, the sewing position of the sewing pattern, or the sewn angle of the sewing pattern in accordance with the projection setting object.

For example, in response to detecting the projection position of the projection setting object M31 of the projection setting object M3 of the projection image Q3 in FIG. 9C by the image sensor 57 (S77: YES), the controller 2 reduces the size of the sewing pattern represented by the pattern image E in the front-rear direction, and also changes the sizes of the pattern image E and the rectangle W in the display image and the projection image Q3 in accordance with the size of the sewing pattern (S78). For example, in response to detecting the projection position of the projection setting object M12 of the projection setting object M1 of the projection image Q1 in FIG. 9A by the image sensor 57 (S77: YES), the controller 2 moves the sewing position of the sewing pattern represented by the pattern image E rightward, and also moves the positions of the pattern image E and the rectangle W in the display image and the projection image Q1 in accordance with the sewing position of the sewing pattern (S78). For example, in response to detecting the projection position of the projection setting object M42 of the projection setting object M4 of the projection image Q4 of FIG. 9D by the image sensor 57 (S77: YES), the controller 2 rotates the angle of the sewing pattern represented by the pattern image E clockwise by 1 degree, and also changes the angles of the pattern image E and the rectangle W in the display image and the projection image Q4 in accordance with the angle of the sewing pattern (S78).

In response to not detecting selection of the projection setting object (S77: NO), or after S78, the controller 2 determines whether a projection end instruction to end the projection process is detected (S82). For example, when the projection process is ended in S11, the controller 2 determines that the projection end instruction is detected. In response to not detecting the projection end instruction (S82: NO), the controller 2 returns the processing to S54. In response to detecting the projection end instruction (S82: YES), the controller 2 ends projection by the projector 58 (S83), and then the projection process ends.

Figure 10A:
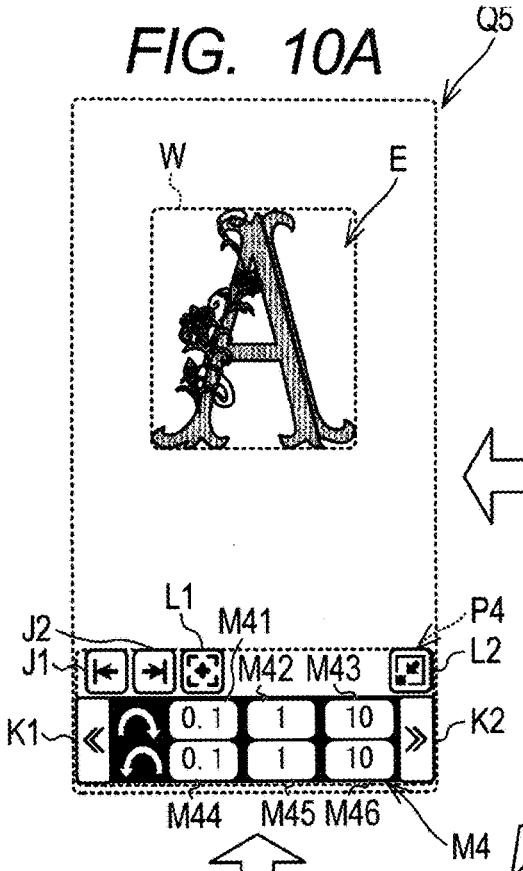
FIGS. 10A, 10B, 10C and 10D are explanatory diagrams of projection images projected on the projection region R1.

FIG. 10A shows a projection image Q5 after the sizes of the sewing pattern represented by the pattern image E in the left-right direction and the front-rear direction are reduced and the sewing position is changed. In response to detecting selection of the position designation object J1 in a state where the projection image Q5 is projected (S54: YES), the controller 2 identifies that the projection position of the object area is the left-aligned position based on the selected position designation object J1 (S55). The controller 2 determines whether the projection setting object and the pattern image overlap each other, assuming that the object area is arranged at the left-aligned position in the projection region (S56). A method of determining whether the projection setting object and the pattern image overlap each other may be set as appropriate. For example, whether the projection setting object and the pattern image overlap each other may be determined based on whether the rectangle W and the object area overlap each other. Whether the projection setting object and the pattern image overlap each other may be determined based on whether at least a part of the projection setting object overlaps the pattern image.

When the pattern image and the projection setting object overlap each other in the projection image (S56: YES), the controller 2 changes the position of the projection setting object in the projection image to a position where the pattern image and the projection setting object do not overlap each other, and resets the projection position of the object area (S57). The method of resetting the projection position of the object area may be set as appropriate. For example, the controller 2 may set the position of the object area from the front-aligned position, the right-aligned position, and the left-aligned position such that the pattern image and the projection setting object do not overlap. The controller 2 may set the position of the object area to a position other than the front-aligned position, the right-aligned position, and the left-aligned position. In a case where the projection position of the object area cannot be reset to a position not overlapping the pattern image, the controller 2 may project an error. As shown in a projection image Q7 of FIG. 10C, when an object area P5 is arranged at the left-aligned position, the projection setting object and the pattern image do not overlap (S56: NO). In this case, the controller 2 does not reset the projection position of the object area P5, but sets the projection position to the position identified in S55.

In response to detecting selection of the position designation object J2 in a state where the projection image Q5 shown in FIG. 10A is projected (S54: YES), the controller 2 identifies that the projection position of the object area is the right-aligned position based on the selected position designation object J2 (S55). As shown in a projection image Q8 of FIG. 10D, when an object area P6 is arranged at the right-aligned position, the projection setting object and the pattern image do not overlap (S56: NO). In this case, the controller 2 does not reset the projection position of the object area P6, but sets the projection position to the position identified in S55.

The controller 2 determines whether the projection position set in S55 or S57 is the front-aligned position (S58). In response to determining that the projection position is the front-aligned position (S58: YES), the controller 2 projects the object area in the second mode and changes the projection position (S59). In response to detecting selection of the position designation object J1 or the position designation object J2 in a state where the projection image Q5 is projected as shown in FIG. 10A (S54: YES), the controller 2 determines that the projection position is not the front-aligned position (S58: NO), and the controller 2 projects the object area in the first mode and changes the projection position (S60).

Figure 10B:
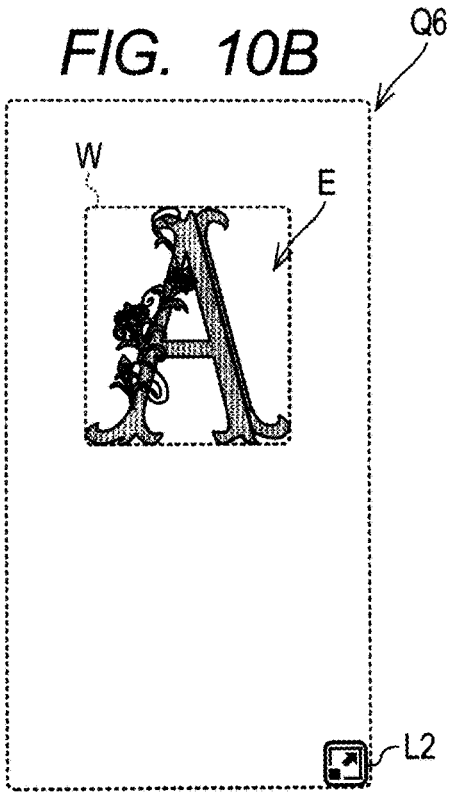
Figure 10C:
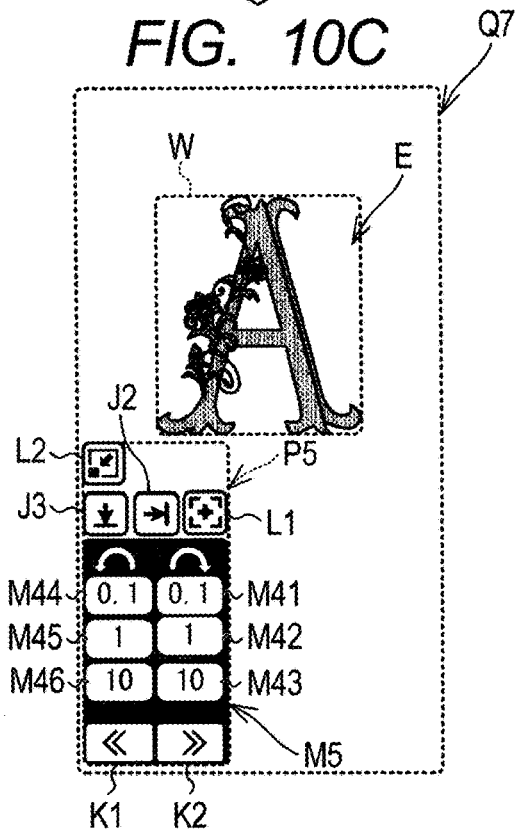

In response to selection of the position designation object J1 (S54: YES), as shown in FIG. 10C, the controller 2 arranges a projection setting object M5 in the projection image Q7 at the left-aligned position designated by the position designation object J1, and projects the projection image Q7 including the object area P5 in the first mode. The projection image Q7 includes the pattern image E, the rectangle W, and the position designation objects J2, J3, the objects L1, K1, K2, the minimization object L2, and the projection setting object M5 in the object area P5. The position designation object J3 is selected to input an instruction to set the object area to the front-aligned position. The longitudinal direction of the object area P5 is the front-rear direction, and the short direction of the object area P5 is the left-right direction. The minimization object L2 is arranged near the left rear end of the object area P5. That is, the minimization object L2 is arranged in the object area P5 in a left-aligned manner.

Figure 10D:
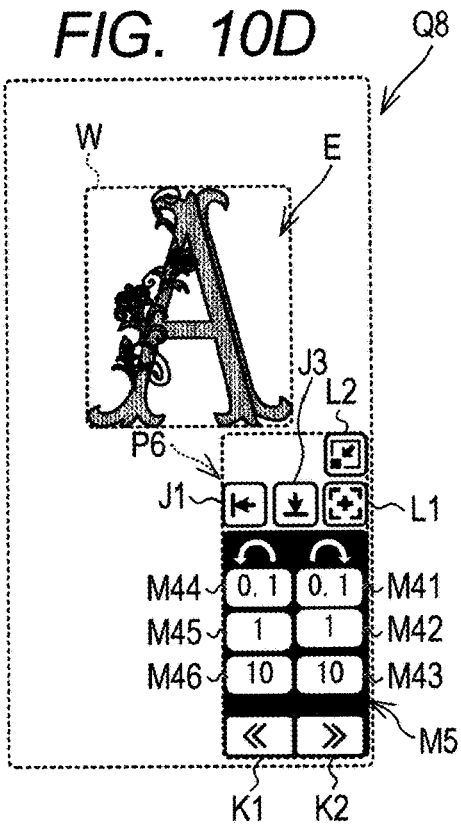

In response to selection of the position designation object J2 (S54: YES), as shown in FIG. 10D, the controller 2 arranges the projection setting object M5 in the projection image Q8 at the right-aligned position designated by the position designation object J2, and projects the projection image Q8 including the object area P6 in the first mode. The projection image Q8 includes the pattern image E, the rectangle W, and the position designation objects J1, J3, the objects L1, K1, K2, the minimization object L2, and the projection setting object M5 in the object area P6. The longitudinal direction of the object area P6 is the front-rear direction, and the short direction of the object area P6 is the left-right direction. When the arrangement of the objects in the object area P5 is compared with the arrangement of the objects in the object area P6, the arrangement (position) of the minimization object L2 is different from each other. The minimization object L2 is arranged near the right rear end of the object area P6. That is, the minimization object L2 is arranged in the object area P6 in a right-aligned manner. After S59 or S60, the controller 2 performs S82.

In response to detecting selection of the minimization object L2 in a state where the projection image Q5 shown in FIG. 10A is projected (S61: YES), the controller 2 determines whether the projection is being performed in the minimization mode (S62). Since the projection image Q5 is not the projection image in the minimization mode (S62: NO), the controller 2 stores the objects being projected in the object area P4 (S63), and performs projection in the minimization mode as shown in a projection image Q6 of FIG. 10B (S64). As shown in FIG. 10B, the projection image Q6 does not include the projection setting object M4, but includes the pattern image E and the minimization object L2. In the minimization mode, the projection image Q6 does not include objects other than the minimization object L2 among the objects projected in the object area P4. The arrangement (position) of the minimization object L2 in the projection image in the minimization mode may be changed as appropriate. For example, the minimization object L2 is arranged at a position not overlapping the pattern image E and the rectangle W. In the projection image Q6, as an example, the minimization object L2 is arranged near the right front end of the projection image Q6.

In response to detecting selection of the minimization object L2 (S61: YES) in a state where the projection image Q6 shown in FIG. 10B is projected, the controller 2 determines that the current mode is the minimization mode (S62: YES). The controller 2 reads the objects stored in the memory 84 in S63 when the mode is shifted from the normal mode to the minimization mode (S65), and performs projection in the normal mode shown in the projection image Q5 of FIG. 10A (S66). The projection image Q5 includes the projection setting object M4, the pattern image E, and the minimization object L2. After S64 or S66, the controller 2 performs S82.

In response to detecting selection of the object K1 is in a state where the projection image Q7 of FIG. 10C is projected (S73: YES), the controller 2 determines that the sewing pattern represented by the pattern image E is not the restricted pattern (S74: NO). The controller 2 projects a projection image Q9 including normal items shown in FIG. 11A (S76). The projection image Q9 includes the pattern image E, the rectangle W, and the position designation objects J2, J3, the objects L1, K1, K2, the minimization object L2, and a projection setting object M6 in an object area P7. The projection image Q9 is different from the projection image Q7 in that projection image Q9 includes the projection setting object M6 in the object area P7 instead of the projection setting object M5 in the object area P5. The projection setting object M6 includes projection setting objects M31 to M35 for setting the size of the sewing pattern, which are similar to the projection setting object M3.

Figure 11A:
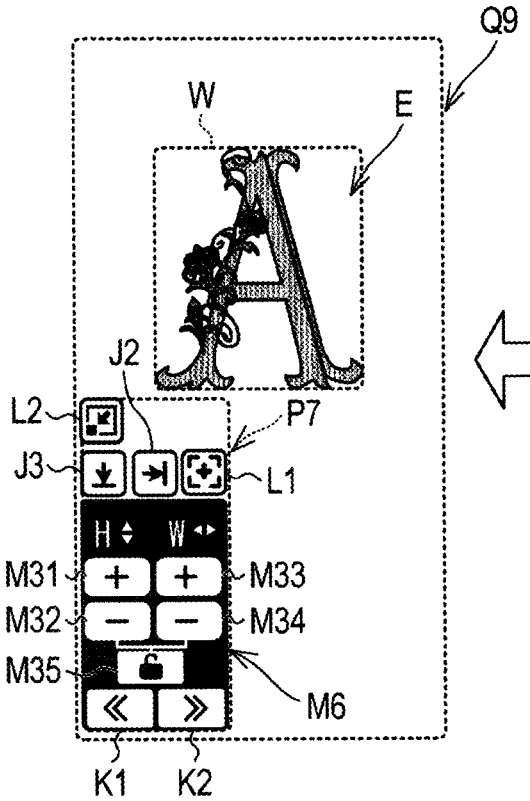
FIGS. 11A and 11B are explanatory diagrams of projection images projected on the projection region R1.
Figure 11B:
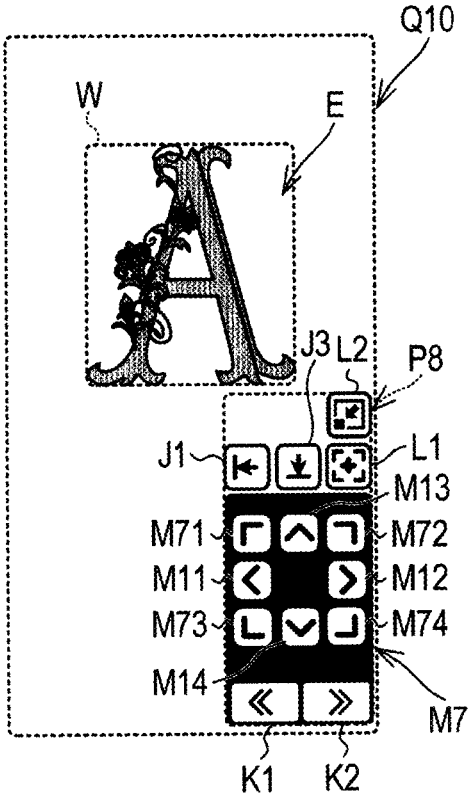

In response to detecting selection of the object K1 in a state where the projection image Q9 of FIG. 11A is projected (S73: YES), the controller 2 determines that the pattern represented by the pattern image E is not the restricted pattern (S74: NO, S76). Further, in response to detecting selection of the position designation object J2 (S54: YES, S55, S56: NO, S58: NO), the controller 2 projects a projection image Q10 shown in FIG. 11B at the right-aligned position (S60). The projection image Q10 includes the pattern image E, the rectangle W, and the position designation objects J1, J3, the objects L1, K1, K2, the minimization object L2, and a projection setting object M7 in an object area P8. The projection image Q10 is different from the projection image Q8 in that the projection image Q10 includes the projection setting object M7 in the object area P8 instead of the projection setting object M5 in the object area P6. The projection setting object M7 includes the projection setting objects M11, M12, M13 and M14 that indicate the moving directions of the sewing pattern, which are similar to the projection setting object M1, and projection setting objects M71, M72, M73 and M74 that indicate moving directions (oblique directions) of the sewing pattern. That is, the types and the number of projection setting objects that indicate the movement directions of the sewing pattern are larger in the case where the projection setting objects are projected in the first mode as shown in FIG. 11B than in the case where the projection setting objects are projected in the second mode as shown in FIG. 9A.

Figure 12A:
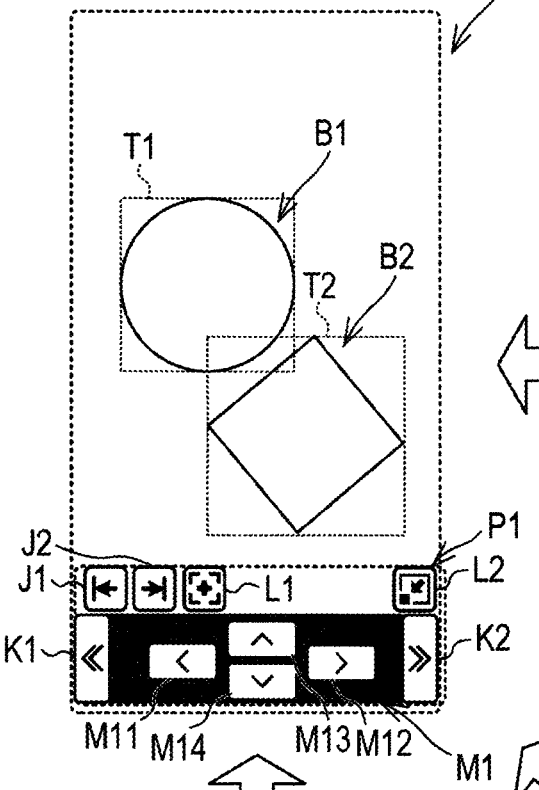
FIGS. 12A, 12B, 12C and 12D are explanatory diagrams of projection images projected on the projection region R1.
Figure 12B:
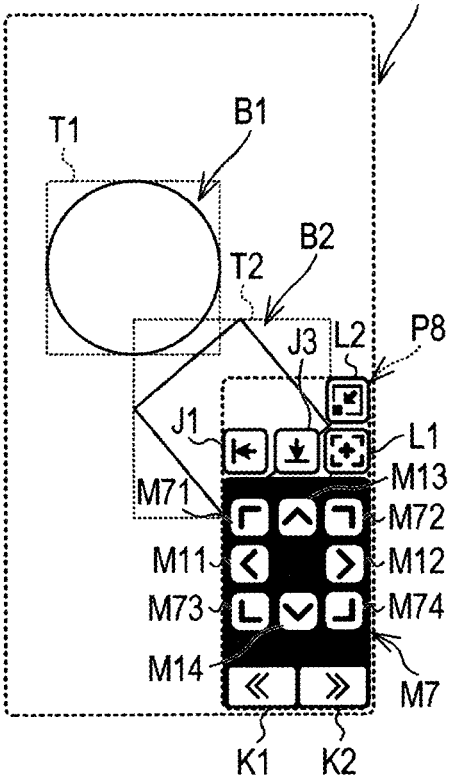
Figure 12C:
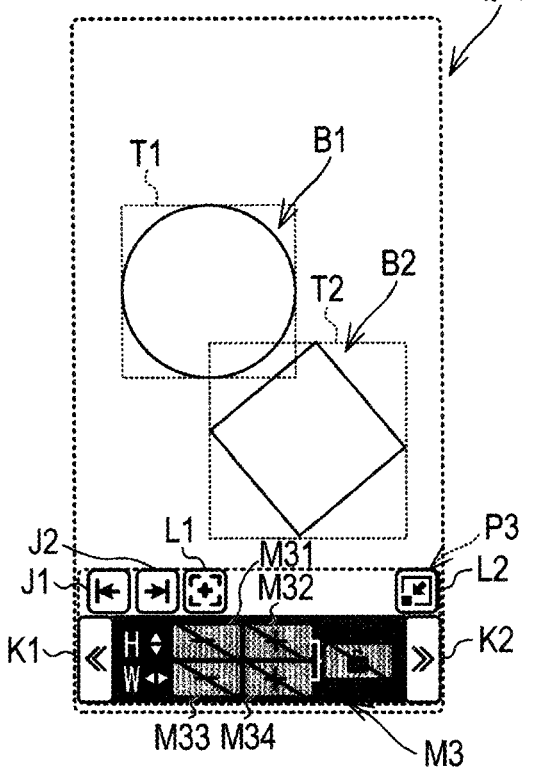
Figure 12D:
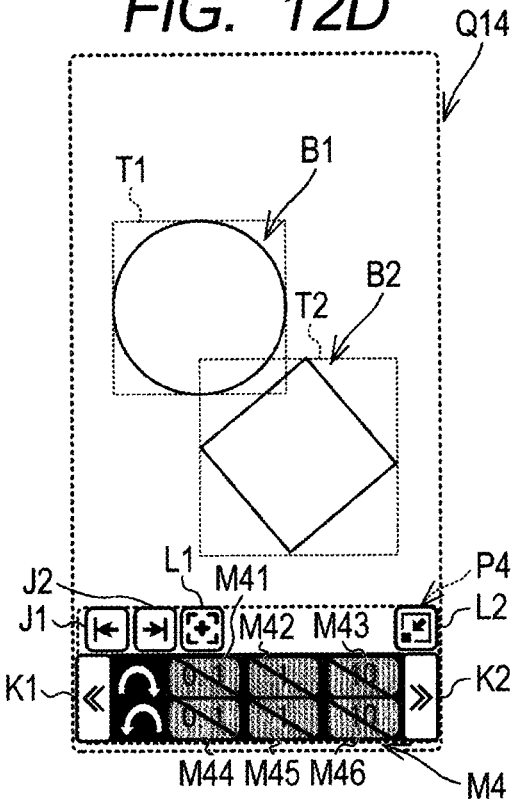

In a case where a first pattern represented by a pattern image B1 and a second pattern represented by a pattern image B2 shown in FIG. 12A are selected patterns, that is, in a case where a plurality of sewing patterns are the selected patterns, a projection image Q11 is projected in S53. The projection image Q11 includes the pattern images B1, B2, rectangles T1, T2, the position designation objects J1, J2, the objects L1, K1, K2, the minimization object L2, and the projection setting object M1. The rectangle Tl is the smallest rectangle that encompasses the sewing pattern represented by the pattern image B1. The rectangle T2 is the smallest rectangle that encompasses the sewing pattern represented by the pattern image B2.

In response to detecting selection of the position designation object J2 in a state where the projection image Q11 is projected (S54: YES), the controller 2 identifies that the projection position of the object area is the right-aligned position based on the selected position designation object J2 (S55). As shown in a projection image Q12 of FIG. 12B, when the object area is arranged at the right-aligned position, the projection setting object and the pattern image overlap each other (S56: YES). In this case, the controller 2 resets the projection position of the object area to the front-aligned position at which the projection setting object and the pattern image do not overlap (S57), and performs S58 and thereafter.

In response to detecting selection of the object K1 or the object K2 in a state where the projection image Q11 is projected (S73: YES), the controller 2 determines that the sewing pattern is a restricted pattern (S74: YES), and projects restricted items (S75). In response to detecting selection of the object K2 (S73: YES, S74: YES), the controller 2 projects a projection image Q13 shown in FIG. 12C. The projection image Q13 includes the pattern images B1, B2, the rectangles T1, T2, the position designation objects J1, J2, objects L1, K1, K2, the minimization object L2, and the projection setting object M3. The projection setting objects M31 to M35 of the projection setting object M3 are represented by a color indicating that the objects are not selectable, and are given oblique lines. In response to detecting selection of the object K1 (S73: YES, S74: YES), the controller 2 projects a projection image Q14 shown in FIG. 12D. The projection image Q14 includes the pattern images B1, B2, the rectangles T1, T2, the position designation objects J1, J2, objects L1, K1, K2, the minimization object L2, and the projection setting object M4. The projection setting objects M41 to M46 of the projection setting object M4 are represented by a color indicating that the objects are not selectable, and are given oblique lines.

In the above-described embodiment, the sewing machine 1 is an example of a sewing machine of the present disclosure. The controller 2 is an example of a controller of the present disclosure. The bed 11 is an example of a bed of the present disclosure. The touch screen 26 is an example of an input interface of the present disclosure. The holder 43 is an example of a holder of the present disclosure. The LCD 15 is an example of a display of the present disclosure. The embroidery frame 50 is an example of an embroidery frame of the present disclosure. The image sensor 57 is an example of a sensor of the present disclosure. The projector 58 is an example of a projector of the present disclosure. The memory 84 is an example of a memory of the present disclosure. The pattern images E, B1, and B2 are examples of a pattern image of the present disclosure. The minimization object L2 is an example of a minimization object of the present disclosure. The position designation objects J1 to J3 are examples of a position designation object of the present disclosure. The projection images Q1 to Q14 are examples of a projection image of the present disclosure. The projection region R1 is an example of a projection region of the present disclosure. The projection setting objects M11 to M14, M31 to M35, M41 to M46, and M71 to M74 are examples of a projection setting object of the present disclosure. The display type objects F1 to F16 are examples of a plurality of display type objects of the present disclosure. S53 is an example of a projection process of the present disclosure. S78 is an example of a projection setting execution process of the present disclosure. S59 and S60 are examples of a change process of the present disclosure. S64 and S66 are examples of a minimization switching process of the present disclosure. S49 is an example of a size acquisition process of the present disclosure. S50 is an example of a type acquisition process of the present disclosure. S3, S10, and S12 are examples of a display process of the present disclosure. S25 and S33 are examples of a display setting execution process of the present disclosure.

The sewing machine 1 of the above-described embodiment includes the bed 11, the projector 58, and the controller 2. The controller 2 performs the projection process of projecting the projection image Q1 onto the projection region R1 of the bed 11 by the projector 58. The projection image Q1 includes the pattern image E representing the sewing pattern and the projection setting object for instructing the setting of the sewing pattern (S53). In response to selection of the projection setting object during the period in which the projection image is being projected (S77: YES), the controller 2 performs the projection setting execution process of performing the setting of the sewing pattern (S78). The controller 2 performs the change process of changing at least the size or the arrangement (position and/or shape) of the projection setting object in the projection image (S59, S60). The change process performed by the controller 2 of the sewing machine 1 contributes to avoiding a situation in which the visibility of the projection setting object that is projected onto the bed 11 is impaired, in comparison to a conventional sewing machine in which the change process is not performed. The change process performed by the controller 2 of the sewing machine 1 contributes to improving the flexibility in the case of projecting the projection setting object compared with a conventional sewing machine. The position of the projection setting object (the object area) includes the front-aligned position (FIG. 10A), the left-aligned position (FIG. 10C), and the right-aligned position (FIG. 10D), for example. The shape of the projection setting object (the object area) includes a horizontally-long shape which is long in the left-right direction (FIG. 10A) and a vertically-long shape which is long in the front-rear direction (FIGS. 10C and 10D), for example.

The setting includes setting of at least the size of the sewing pattern, the sewing position of the sewing pattern, or the sewing angle of the sewing pattern. In response to detecting that the user has selected the projection setting object included in the projection image (S77: YES), the sewing machine 1 performs the setting process of at least the size of the sewing pattern, the sewing position of the sewing pattern, or the sewn angle of the sewing pattern (S78). The controller 2 of the sewing machine 1 contributes to improving the flexibility in the case of performing the setting of at least the size of the sewing pattern, the sewing position of the sewing pattern, or the sewing angle of the sewing pattern by using the projection setting object included in the projection image.

The sewing machine 1 includes the image sensor 57 configured to detect a position in the projection region R1 that is designated by the pen 100 serving as a pointing body. In the projection setting execution process, in response to detecting the position at which the projection setting object is projected by the image sensor 57 during the period in which the projection image is being projected (S77: YES), the controller 2 performs the setting of the sewing pattern (S78). The image sensor 57 of the sewing machine 1 contributes to enabling the user to easily select the projection setting object by using the pointing body.

The image sensor 57 is configured to capture an image on the bed 11. In the projection setting execution process, in response to detecting the position at which the projection setting object is projected, based on the captured image captured by the image sensor 57 (S77: YES), the controller 2 performs setting of the sewing pattern (S78). The image sensor 57 of the sewing machine 1 contributes to accurately detecting that the position at which the projection setting object is projected is designated by the pointing body based on the captured image.

The projection image Q5 of FIG. 10A includes the position designation objects J1 and J2 for designating a position at which the projection setting object is arranged. In the change process, in response to selection of the position designation object J1 by the user (S54: YES), as shown in FIG. 10C, the controller 2 arranges the projection setting objects M41 to M46 in the projection image Q5 at the position designated by the position designation object J1 (S60). The change process performed by the controller 2 of the sewing machine 1 changes the arrangement of the projection setting object in the projection image by the position designation object of the projection image, and thus, contributes to easily changing the arrangement of the projection setting object in the projection image in conjunction with the projection setting execution process. The change process performed by the controller 2 of the sewing machine 1 contributes to facilitating an operation for changing the projection setting object in the projection image, in consideration of the arrangement of the pattern image E in the projection image, and so on.

The projection image Q5 includes the minimization object L2. In response to selection of the minimization object L2 by the user (S61: YES), the controller 2 performs the minimization switching process of switching between the normal mode (S66) and the minimization mode (S64). As shown in FIG. 10A, in the normal mode, the controller 2 projects the projection image Q5 including the pattern image E, the projection setting objects M41 to M46, and the minimization object L2. As shown in FIG. 10B, in the minimization mode, the controller 2 projects the projection image Q6 that does not include the projection setting object but includes the pattern image E and the minimization object L2. The minimization switching process performed by the controller 2 of the sewing machine 1 contributes to improving the flexibility in the case of projecting the projection setting object compared with the case of projecting the projection setting object all the time. The minimization switching process performed by the controller 2 of the sewing machine 1 contributes to switching whether to include the projection setting object in the projection image, by a simple operation of the user selecting the projected minimization object L2. The minimization switching process of the sewing machine 1 contributes to avoiding a situation in which the user has difficulty in checking the pattern image E in the projection image due to the projection setting object being included in the projection image when editing of the sewing pattern is not performed.

The sewing machine 1 includes the holder 43 to which the embroidery frame 50 is attachable. The controller 2 performs the type acquisition process of acquiring the type of the embroidery frame 50 that is attached to the holder 43 (S2). In the projection process, in a case where the type of the embroidery frame 50 is the particular type (S51: YES), the controller 2 projects the projection image Q1 including the pattern image E and the projection setting object (S53). In a case where the type of the embroidery frame 50 is not the particular type (S51: NO), the controller 2 projects the projection image that includes the pattern image E and does not include the projection setting object (S81). The type acquisition process and the projection process performed by the controller 2 of the sewing machine 1 contribute to automatically switching whether to include the projection setting object in the projection image, depending on the type of the embroidery frame 50 that is attached to the holder 43. The projection process performed by the controller 2 of the sewing machine 1 contributes to avoiding a situation in which the projection image including the projection setting object is projected when the type of the embroidery frame 50 attached to the holder 43 is not suitable for including the projection setting object in the projection image.

The controller 2 performs the size acquisition process of acquiring the size of the sewing pattern (S49). In the projection process, in a case where the size of the sewing pattern and the size of the projection region RI satisfy the particular condition (S51: YES), the controller 2 projects the projection image including the pattern image E and the projection setting object (S53). In a case where the size of the sewing pattern and the size of the projection region R1 do not satisfy the particular condition (S51: NO), the controller 2 projects the projection image that includes the pattern image E and does not include the projection setting object (S81). The size detection process and the projection process performed by the controller 2 of the sewing machine 1 contribute to automatically switching whether to include the projection setting object in the projection image, depending on whether the size of the sewing pattern and the size of the projection region R1 satisfy the particular condition. The projection process performed by the controller 2 of the sewing machine 1 contributes to avoiding a situation in which the projection image including the projection setting object is projected when the combination of the size of the sewing pattern and the size of the projection region R1 is not suitable for including the projection setting object in the projection image.

In the change process, when the pattern image and the projection setting object in the projection image overlap each other (S56: YES), the controller 2 changes the position of the projection setting object in the projection image to a position at which the pattern image and the projection setting object do not overlap each other (S57). The change process performed by the controller 2 of the sewing machine 1 contributes to automatically avoiding a situation in which the projection setting object and the pattern image are projected in a state where the projection setting object and the pattern image overlap each other.

The projection image Q5 of FIG. 10A includes the plurality of projection setting objects M41 to M46. In the change process, the controller 2 switches between the second mode (S59) and the first mode (S60) shown in FIG. 10C. In the second mode shown in FIG. 10A, the longitudinal direction of the object area P4 in which the plurality of the projection setting objects M41 to M46 are arranged in the projection image Q5 coincides with the short direction of the projection image Q5. In the first mode shown in FIG. 10C, the longitudinal direction of the object area P5 in which the plurality of the projection setting objects M41 to M46 are arranged in the projection image Q7 coincides with the longitudinal direction of the projection image Q7. The change process performed by the controller 2 of the sewing machine 1 contributes to improving the flexibility in the case of projecting the projection setting object, compared with the case where the shape of the object area is not changed.

The sewing machine 1 includes the LCD 15. As shown in FIG. 4, the controller 2 displays, on the display, the first display image G1 including the plurality of display type objects F1 to F16 for selecting the setting type of the sewing pattern during a period in which the projection process is not being performed (S3, S12). As shown in FIG. 7, the controller 2 performs the display process of displaying, on the display, the second display image G30 including a part of the plurality of display type objects F1 to F16 included in the first display image G1 during a period in which the projection image is being projected (S10). The controller 2 performs the setting execution process of performing setting of the sewing pattern in accordance with the display type object selected from the plurality of projection setting objects (S25, S33). The display process performed by the controller 2 of the sewing machine 1 contributes to automatically changing the display image that is displayed on the LCD 15 between the first display image G1 and the second display image G30, depending on whether the display image is being projected. In the display process performed by the controller 2 of the sewing machine 1, the second display image G30 does not include the projection setting objects that are not suitable for being performed during a period in which the projection process is being performed. Thus, the display process contributes to reliably avoiding a situation in which such projection setting object is selected during the period in which the projection process is being performed.

The sewing machine 1 includes the LCD 15 and the memory 84. The memory 84 stores the projection setting objects and the display type objects F1 to F16 that are displayed on the LCD 15 and that are used to select the setting type of the sewing pattern. The projection setting objects correspond to a part of the setting types selected by the plurality of display type objects. The controller 2 performs the display process of displaying the display image including the display type objects F1 to F16 on the LCD 15 (S3, S10, S12, S23, S31). The controller 2 performs the setting execution process of performing setting of the sewing pattern in accordance with the display type object selected from the plurality of display type objects FP (S25, S33). The display process performed by the controller 2 of the sewing machine 1 contributes to improving the convenience of the user when performing setting of the sewing pattern based on the projected projection image, by excluding the projection setting object corresponding to the setting type that is not suitable for performing setting of the sewing pattern based on the projected projection image.

While the present disclosure has been described in conjunction with various example structures outlined above and illustrated in the figures, various alternatives, modifications, variations, improvements, and/or substantial equivalents, whether known or that may be presently unforeseen, may become apparent to those having at least ordinary skill in the art. Accordingly, the example embodiments of the disclosure, as set forth above, are intended to be illustrative of the disclosure, and not limiting the disclosure. Various changes may be made without departing from the spirit and scope of the disclosure. Thus, the disclosure is intended to embrace all known or later developed alternatives, modifications, variations, improvements, and/or substantial equivalents. Some specific examples of potential alternatives, modifications, or variations in the described disclosure are provided below.

The present disclosure may be implemented in various forms, and may be implemented in the form of, for example, a sewing machine program, a non-transitory computer-readable storage medium storing a sewing machine program, a method of controlling a sewing machine, and so on. The sewing machine 1 may include a movement mechanism for moving an embroidery frame in the front-rear direction and the left-right direction. The sewing machine 1 may not be provided with the holder 43 to which the embroidery frame 50 is attachable and the movement device 40, and may perform sewing by moving the sewing workpiece C by the feed dog 24. The sewing machine 1 may be a sewing machine dedicated to embroidery sewing that does not include the feed dog 24. The configuration of the display may be changed as appropriate.

The type, the arrangement, the fixing position, the fixing method, and the projection region R1 of the projector 58 may be changed as appropriate. The projection region R1 may not include the needle drop position. The projection region R1 may have a shape other than a rectangular shape, such as a square shape, or may have a rectangular shape with long sides extending in the extending direction J. The sensor configured to detect the position in the projection region R1 designated by the pointing body may be appropriately changed according to the pointing body, and is not limited to the image sensor 57. In a case where the pointing body is an ultrasonic pen configured to generate an ultrasonic wave, the sensor may be an ultrasonic detector. The type, the arrangement, and the capturing region R2 of the image sensor 57 may be changed as appropriate. The arrangement of the image sensor 57 with respect to the projector 58 may be changed as appropriate.

At least the display image or the projection image is not limited to being generated by the sewing machine 1, and may be generated by another apparatus such as a personal computer or a smartphone and that is acquired by the sewing machine 1. The setting types of the sewing pattern may be changed as appropriate, and may be a part of the sixteen setting types shown in FIG. 13, or may include setting types other than the sixteen setting types. The display type objects included in the display screen during execution time of the projection process may be the same as the display type objects included in the display screen during non-execution time of the projection process.

The number, the arrangement, and the corresponding setting type of the projection setting objects included in the projection image may be changed as appropriate. The number and types of display type objects included in the display type object FP may be changed as appropriate. The setting type may be changed as appropriate, and may be, for example, any of the setting of the size of the sewing pattern, the sewing position of the sewing pattern, or the sewing angle of the sewing pattern. The sewing machine 1 need not be provided with a sensor. In this case, for example, the sewing machine 1 may detect selection of the projection setting object based on a pointer in the projection image being moved by a pointing device such as a mouse.

The controller 2 may change at least the size or the arrangement (position or shape) of the projection setting object in the projection image. The projection image may not include the position designation object, or the type of the position designation object may be changed. In this case, the sewing machine 1 may change the arrangement of the projection setting object in the projection image in response to a drag operation of the projection setting object in the projection image by a pointing device such as a mouse or a pointing body, for example. The sewing machine 1 may change the arrangement of the projection setting object in the projection image in response to a drag operation of the projection setting object in the projection image by a pointing device such as a mouse, for example.

The projection image may not include the minimization object L2. The arrangement of the minimization object L2 in the projection image in at least the normal mode or the minimization mode may be changed as appropriate, or the user may be able to designate the arrangement of the minimization object L2 in the projection image. The controller 2 may perform at least an enlargement mode in which the projection setting object is enlarged by a particular amount and is projected or a reduction mode in which the projection setting object is reduced by a particular amount and is projected. The arrangement of the projection setting object in the object area may be automatically set in consideration of the frequency of selection and so on, or may be changeable by the user.

The particular condition of S51 may be set as appropriate. For example, the particular condition may be satisfied when the size of the embroidery frame is larger than a particular size, without being limited to the size of the sewing region. S51 may be omitted, and the controller 2 may perform S52 and thereafter regardless of the particular condition. S56 and S57 may be omitted, and may project a projection image in which the pattern image and the projection setting object in the projection image overlap each other. In this case, which of the pattern image and the projection setting object is preferentially projected may be selectable or switchable. The controller 2 may arrange the projection setting object at a position in the projection image where an overlap area or an overlap ratio (a ratio of the overlap area to the area of the projection image) of the pattern image and the projection setting object is smaller than or equal to a particular amount. The longitudinal direction of the object area may be unchangeable. The type and number of projection setting objects may be the same or different between the first mode and the second mode. The controller 2 may display, on the LCD 15, a display image including the same plurality of projection setting objects in a period in which the projection process is being performed and a period in which the projection process is not being performed.

The contents of the table 87 stored in the memory 84 may be changed as appropriate. The number of the plurality of display setting objects corresponding to the display type object FP may be the same as the number of the projection setting objects projected in the projection image. The type, design, number, and so on of the setting object for instructing the setting of the sewing pattern may be the same between the display setting objects included in the display image and the projection setting objects included in the projection image. S74 and S75 may be omitted, and the controller 2 may not change the projection method of the projection setting object in the projection image and whether to accept the setting of the sewing pattern using the projection setting object, depending on whether the sewing pattern is the restricted pattern. The projection order of the projection setting objects M1 to M3 may be changed as appropriate, and may be automatically set in consideration of the frequency of selection and so on, or may be changeable by the user.

What is claimed is:

1. A sewing machine comprising:

a bed;

a projector; and a controller configured to:

control the projector to project a projection image onto a projection region on the bed, the projection image including a pattern image representing a sewing pattern, a projection setting object for instructing setting of the sewing pattern, and a position designation object for designating a position at which the projection setting object is arranged, the position designation object being different from the projection setting object;

in response to selection of the projection setting object during a period in which the projection image is being projected, perform the setting of the sewing pattern; and in response to selection of the position designation object, change a position of the projection setting object in the projection image to a position designated by the position designation object.

2. The sewing machine according to claim 1, wherein the setting includes at least a size of the sewing pattern, a sewing position of the sewing pattern, or a sewing angle of the sewing pattern.

3. The sewing machine according to claim 1, further comprising:

a sensor configured to detect a position in the projection region, the position being pointed by a pointing body, wherein the controller is configured to:

in response to detecting, by the sensor, a position at which the projection setting object is projected during the period in which the projection image is being projected, perform the setting of the sewing pattern.

4. The sewing machine according to claim 3, wherein the sensor is an image sensor configured to capture an image on the bed; and wherein the controller is configured to:

in response to detecting the position at which the projection setting object is projected based on a captured image captured by the image sensor, perform the setting of the sewing pattern.

5. The sewing machine according to claim 1, wherein the projection image includes a minimization object; and wherein the controller is configured to:

in response to selection of the minimization object, perform a minimization switching process of switching between:

a normal mode of projecting the projection image including the pattern image, the projection setting object, and the minimization object; and a minimization mode of projecting the projection image not including the projection setting object and including the pattern image and the minimization object.

6. The sewing machine according to claim 1, further comprising a holder to which an embroidery frame is attachable, wherein the controller is configured to:

acquire a type of the embroidery frame attached to the holder;

in response to determining that the type of the embroidery frame is a particular type, project the projection image including the pattern image and the projection setting object; and in response to determining that the type of the embroidery frame is not the particular type, project the projection image including the pattern image and not including the projection setting object.

7. The sewing machine according to claim 1, wherein the controller is configured to:

acquire a size of the sewing pattern;

in response to determining that the size of the sewing pattern and a size of the projection region satisfy a particular condition, project the projection image including the pattern image and the projection setting object; and in response to determining that the size of the sewing pattern and the size of the projection region do not satisfy the particular condition, project the projection image including the pattern image and not including the projection setting object.

8. The sewing machine according to claim 1, wherein the controller is configured to:

in response to determining that the pattern image and the projection setting object overlap in the projection image, change a position of the projection setting object in the projection image to a position at which the pattern image and the projection setting object do not overlap.

9. The sewing machine according to claim 1, wherein the projection image includes a plurality of projection setting objects; and wherein the controller is configured to change an arrangement mode of the plurality of projection setting objects between:

a first mode in which the plurality of projection setting objects are arranged in the projection image such that a longitudinal direction of an object area coincides with a longitudinal direction of the projection image, the object area being an area in which the plurality of projection setting objects are arranged; and a second mode in which the plurality of projection setting objects are arranged in the projection image such that the longitudinal direction of the object area coincides with a short direction of the projection image.

10. The sewing machine according to claim 1, further comprising a display, wherein the controller is configured to:

display a first display image on the display during a period in which the projection image is not being projected, and display a second display image on the display during a period in which the projection image is being projected, the first display image including a plurality of display type objects for selecting a setting type of the sewing pattern, the second display image including a part of the plurality of display type objects included in the first display image; and perform setting of the sewing pattern in accordance with a display type object selected from the plurality of display type objects.

11. The sewing machine according to claim 1, further comprising:

a display; and a memory configured to store the projection setting object and a plurality of display type objects for selecting a setting type of the sewing pattern, the plurality of display type objects being displayed on the display, wherein the projection setting object corresponds to a part of setting types that are selectable through the plurality of display type objects; and wherein the controller is configured to:

display a display image including the plurality of display type objects on the display; and perform setting of the sewing pattern in accordance with a display type object selected from the plurality of display type objects.

12. The sewing machine according to claim 1, wherein the controller is configured to change a shape of the projection setting object in the projection image.

13. The sewing machine according to claim 1, wherein the position designated by the position designation object is changeable among a right-aligned position at which the projection setting object is arranged at a right end of the projection image, a front-aligned position at which the projection setting object is arranged at a front end of the projection image, and a left-aligned position at which the projection setting object is arranged at a left end of the projection image.

14. The sewing machine according to claim 1, wherein the controller is configured to:

in response to determining that the pattern image and the projection setting object overlap in the projection image, change a position of the projection setting object in the projection image to a position at which an overlap area or an overlap ratio of the pattern image and the projection setting object is smaller than or equal to a particular amount.

15. The sewing machine according to claim 1, further comprising a memory configured to store a projection order of a plurality of setting types including a first setting type and a second setting type, wherein the projection image includes a switch object for switching the plurality of setting types in accordance with the projection order; and wherein the controller is configured to:

in response to detecting selection of the switch object, switch the projection image from a first projection image to a second projection image, the first projection image including a first projection setting object for performing setting of the first setting type, the second projection image including a second projection setting object for performing setting of the second setting type.

16. A sewing machine comprising:

a bed;

a projector; and a controller configured to:

control the projector to project a projection image onto a projection region on the bed, the projection image including a pattern image representing a sewing pattern, a projection setting object for instructing setting of the sewing pattern, and a minimization object;

in response to selection of the projection setting object during a period in which the projection image is being projected, perform the setting of the sewing pattern;

change at least a size or an arrangement of the projection setting object in the projection image; and in response to selection of the minimization object, perform a minimization switching process of switching between:

a normal mode of projecting the projection image including the pattern image, the projection setting object, and the minimization object; and a minimization mode of projecting the projection image not including the projection setting object and including the pattern image and the minimization object.

17. A sewing machine comprising:

a bed;

a holder to which an embroidery frame is attachable;

a projector; and a controller configured to:

control the projector to project a projection image onto a projection region on the bed, the projection image including a pattern image representing a sewing pattern and a projection setting object for instructing setting of the sewing pattern;

in response to selection of the projection setting object during a period in which the projection image is being projected, perform the setting of the sewing pattern;

change at least a size or an arrangement of the projection setting object in the projection image;

acquire a type of the embroidery frame attached to the holder;

in response to determining that the type of the embroidery frame is a particular type, project the projection image including the pattern image and the projection setting object; and in response to determining that the type of the embroidery frame is not the particular type, project the projection image including the pattern image and not including the projection setting object.

18. A sewing machine comprising:

a bed;

a projector; and a controller configured to:

control the projector to project a projection image onto a projection region on the bed, the projection image including a pattern image representing a sewing pattern and a projection setting object for instructing setting of the sewing pattern;

in response to selection of the projection setting object during a period in which the projection image is being projected, perform the setting of the sewing pattern;

change at least a size or an arrangement of the projection setting object in the projection image; and in response to determining that the pattern image and the projection setting object overlap in the projection image, change a position of the projection setting object in the projection image to a position at which the pattern image and the projection setting object do not overlap.

* * * * *